US006561474B1

(12) United States Patent
Walter et al.

(10) Patent No.: US 6,561,474 B1
(45) Date of Patent: May 13, 2003

(54) DISPLAY DEVICE FOR PRESENTATION OF GOODS

(75) Inventors: Herbert Walter, Mullheim (DE); Manfred Uecker, Rheinfelden (DE)

(73) Assignee: Visplay International AG, Muttenz (CH)

( * ) Notice: Subject to any disclaimer, the term of this patent is extended or adjusted under 35 U.S.C. 154(b) by 0 days.

(21) Appl. No.: 09/719,716

(22) PCT Filed: Jun. 18, 1999

(86) PCT No.: PCT/CH99/00264

§ 371 (c)(1),
(2), (4) Date: Dec. 15, 2000

(87) PCT Pub. No.: WO99/65368

PCT Pub. Date: Dec. 23, 1999

(30) Foreign Application Priority Data

| | | |
|---|---|---|
| Jun. 18, 1998 | (EP) | 98810559 |
| Nov. 3, 1998 | (EP) | 98811096 |
| Dec. 28, 1998 | (WO) | PCT/CH98/00554 |
| Feb. 10, 1999 | (WO) | PCT/CH99/00059 |

(51) Int. Cl.[7] ..... E04G 3/00; A47G 5/08

(52) U.S. Cl. ..... 248/220.22; 248/220.31; 211/94.01; 52/36.4

(58) Field of Search ..... 248/220.22, 225.21, 248/220.31, 227.1, 227.4, 307; 211/59.1, 13.1, 94.01; 52/36.4

(56) References Cited

U.S. PATENT DOCUMENTS

| | | | | |
|---|---|---|---|---|
| 1,800,387 A | * | 4/1931 | Greist | 248/307 |
| 2,754,974 A | * | 7/1956 | Larson | 211/70.6 |
| 3,409,260 A | * | 11/1968 | Bleed | 248/220.22 |
| 4,094,415 A | * | 6/1978 | Larson | 211/57.1 |
| 4,308,961 A | | 1/1982 | Kunce | |
| 4,352,478 A | * | 10/1982 | Loew | 248/222.11 |
| 4,591,058 A | * | 5/1986 | Amstutz et al. | 211/94.01 |
| 4,678,151 A | * | 7/1987 | Radek | 248/223.41 |
| 4,869,378 A | * | 9/1989 | Miller | 211/94.01 |
| 4,989,815 A | | 2/1991 | McAuley | |
| 5,125,518 A | | 6/1992 | Ward | |
| 5,138,803 A | * | 8/1992 | Grossen | 52/36.4 |
| 6,119,878 A | * | 9/2000 | Zen | 211/94.01 |

FOREIGN PATENT DOCUMENTS

| | | |
|---|---|---|
| CH | 650137 | 7/1985 |
| DE | 3438759 | 7/1985 |
| EP | 0568158 | 11/1993 |
| FR | 2611468 | 9/1988 |
| GB | 2133685 | 8/1984 |
| GB | 2206033 | 12/1988 |
| GB | 2222070 | 2/1990 |
| GB | 2241426 | 9/1991 |
| WO | 9114388 | 10/1991 |

OTHER PUBLICATIONS

Kesseböhmer GmbH, Bad Essen, Germany, "Linero®—System 2000 . . . für Nischen mit Profil", 1996, front cover, pp. 3–4, 6, 9, back cover.

German Design Reg. No. M 96 00218, German Geschmacksmusterblatt Heft 19 vom 10.10.1996, pp. 4981–4988.

* cited by examiner

*Primary Examiner*—Anita King
(74) *Attorney, Agent, or Firm*—Selitto, Behr & Kim

(57) ABSTRACT

A display device for presentation of goods includes a support panel and a horizontal rod with a longitudinal groove fixed to the panel. Supporting arms with a rod part extending from a plate with bent tongue are attached to the horizontal rod by hooking the tongue into the longitudinal groove from underneath. In an alternative embodiment, the plate may have a hook that hooks into a slot provided on an upper surface of the rod. The supporting arms may support goods or shelves.

64 Claims, 12 Drawing Sheets

Figure 3C:
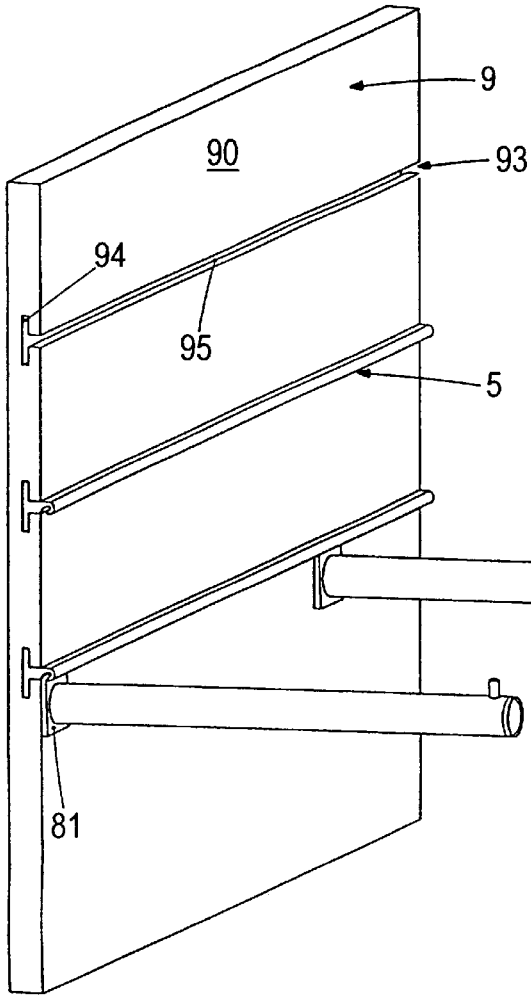

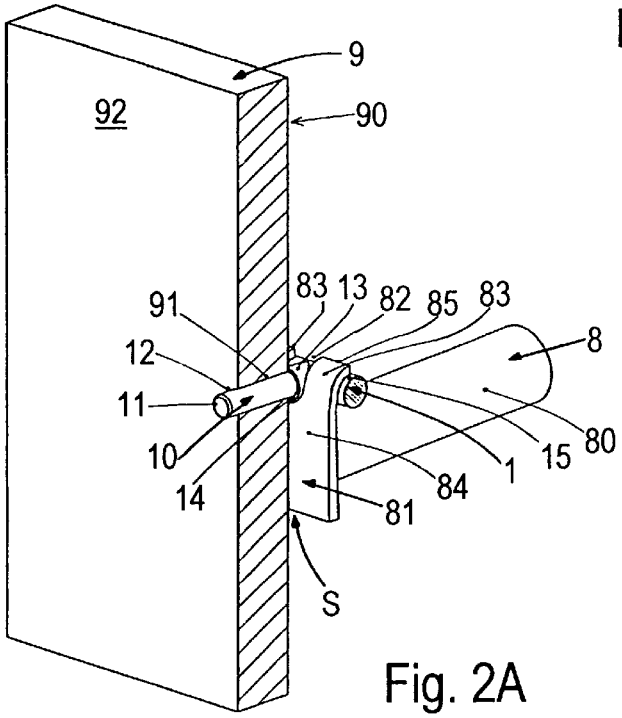
Fig. 2A
Fig. 1A
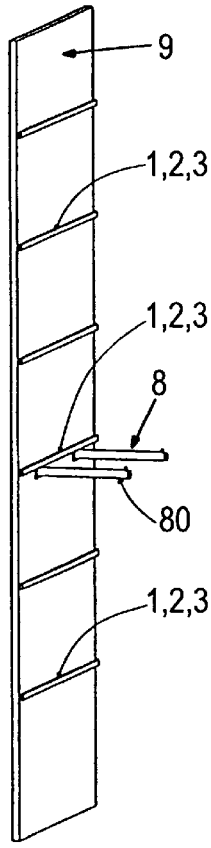
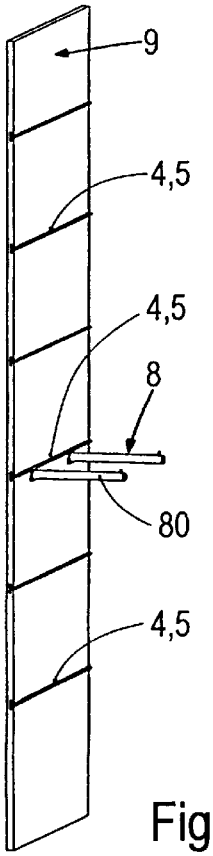
Fig. 1B
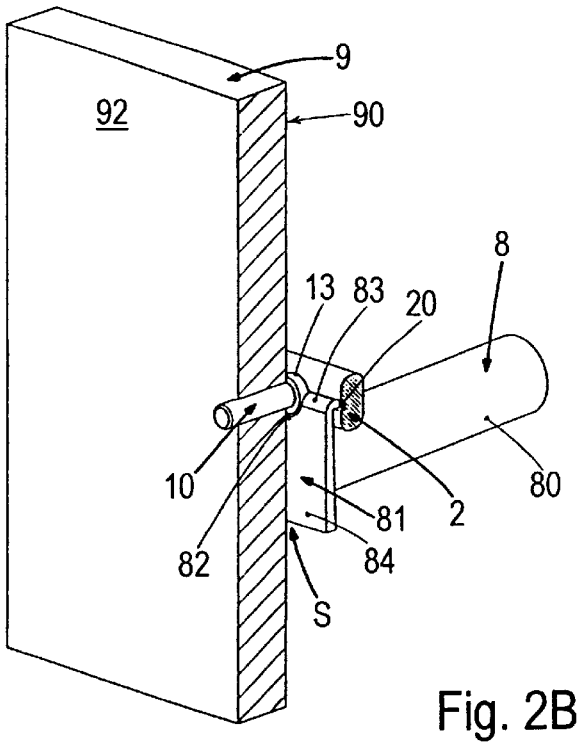
Fig. 2B

Fig. 2C
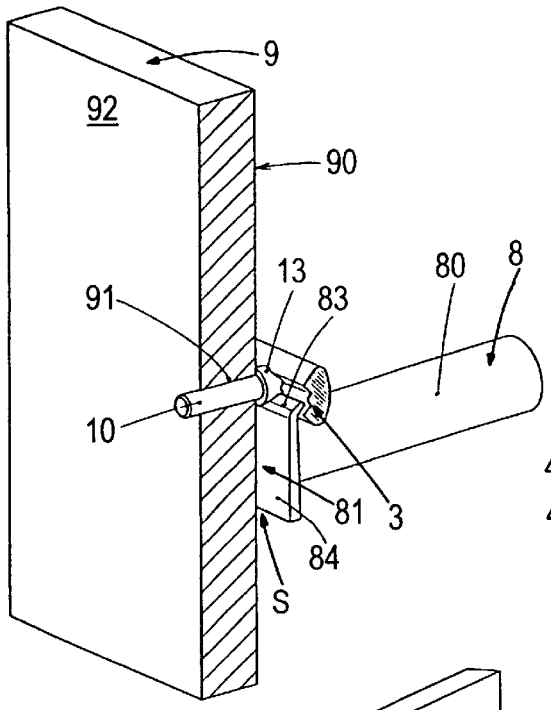
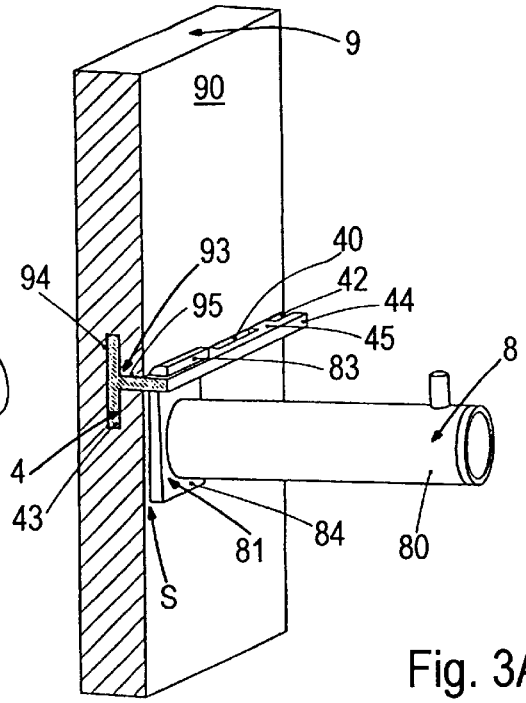
Fig. 3A
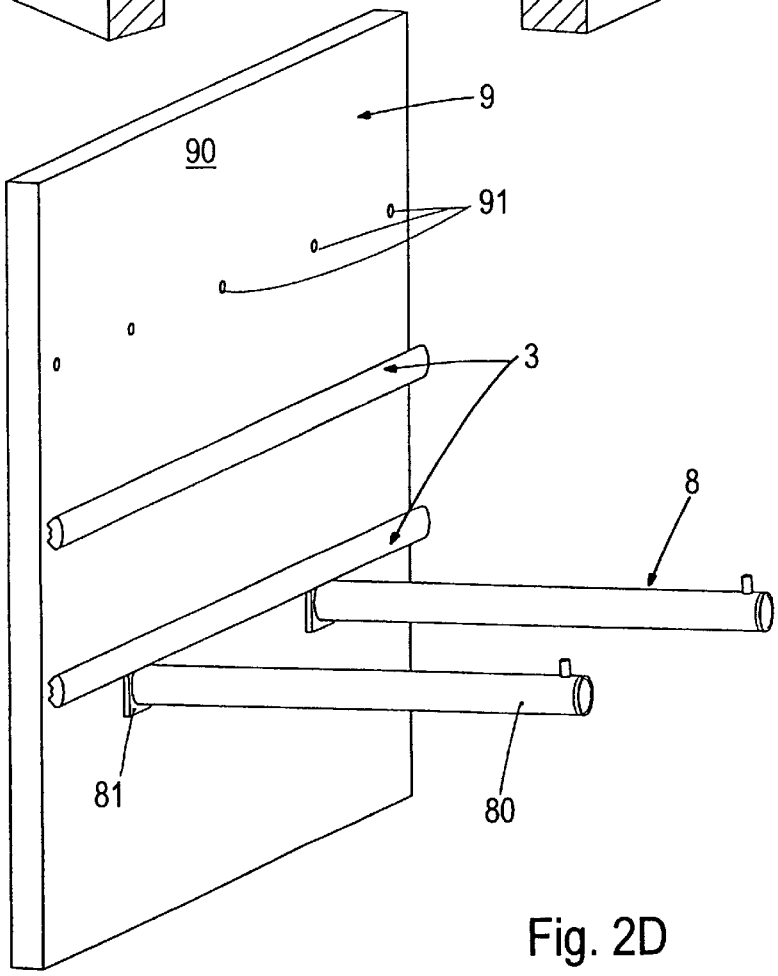
Fig. 2D

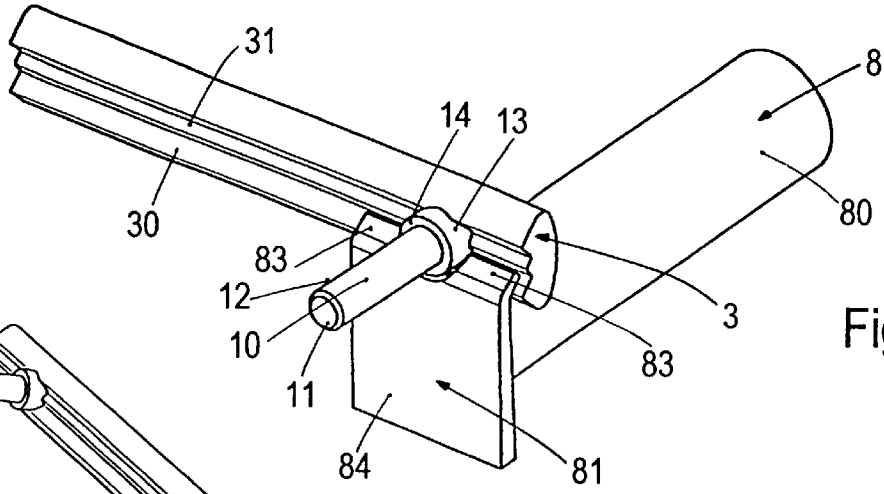
Fig. 5C
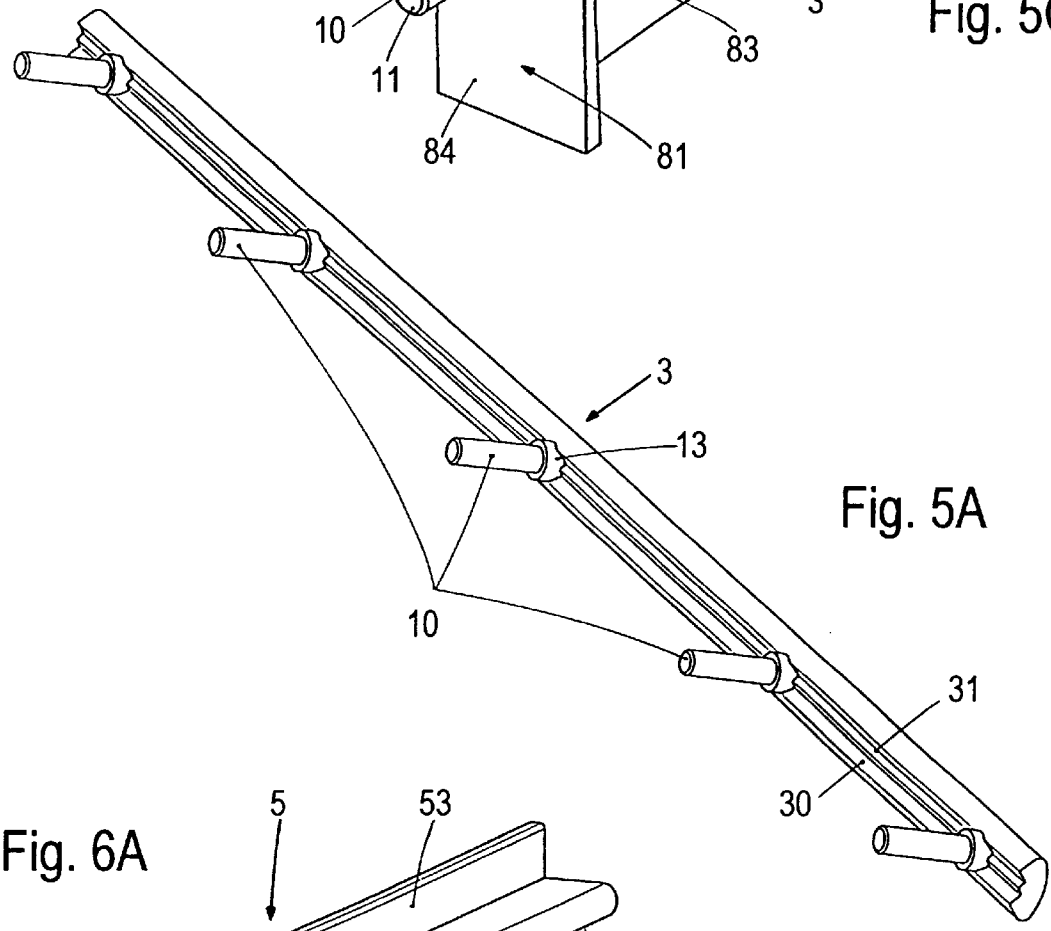
Fig. 5A
Fig. 6A
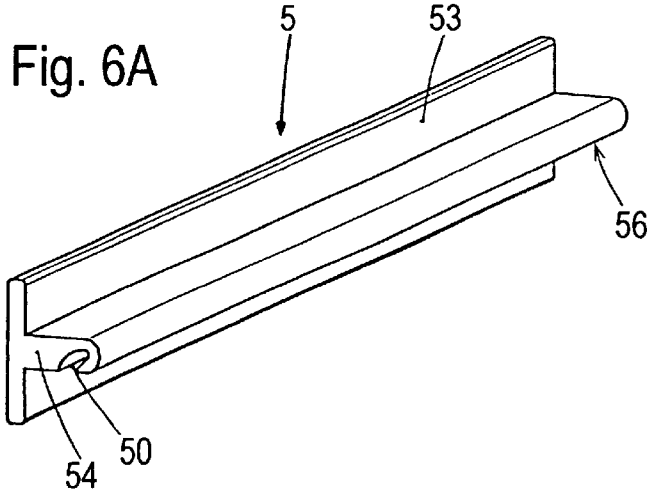
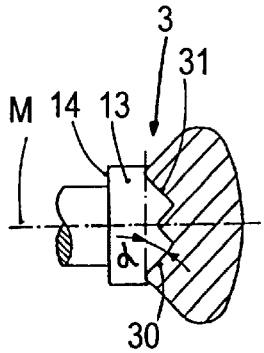
Fig. 5B

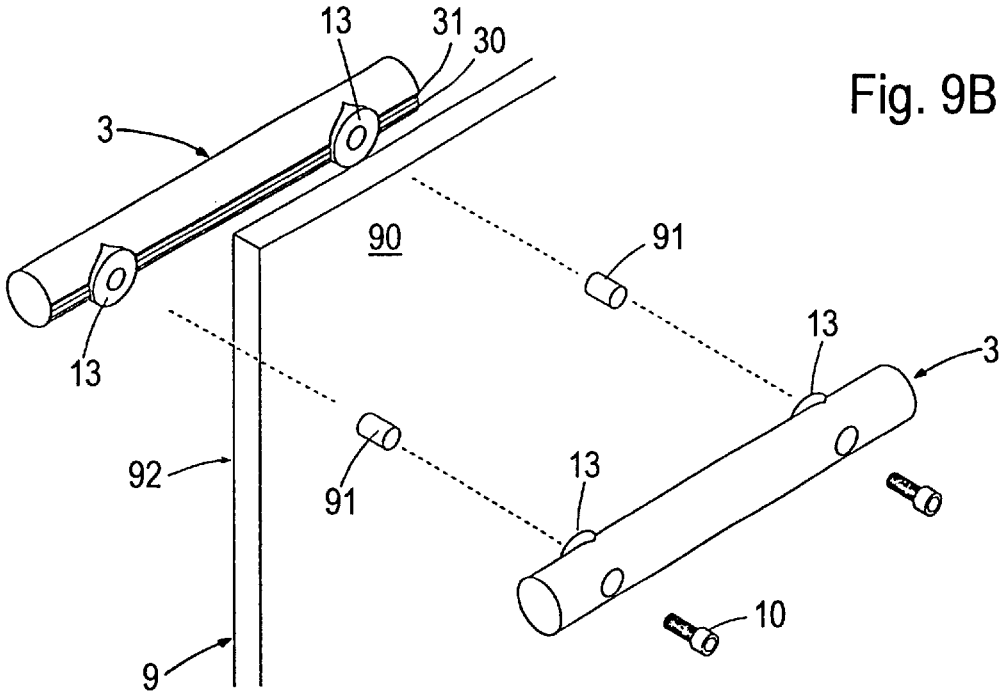
Fig. 9B
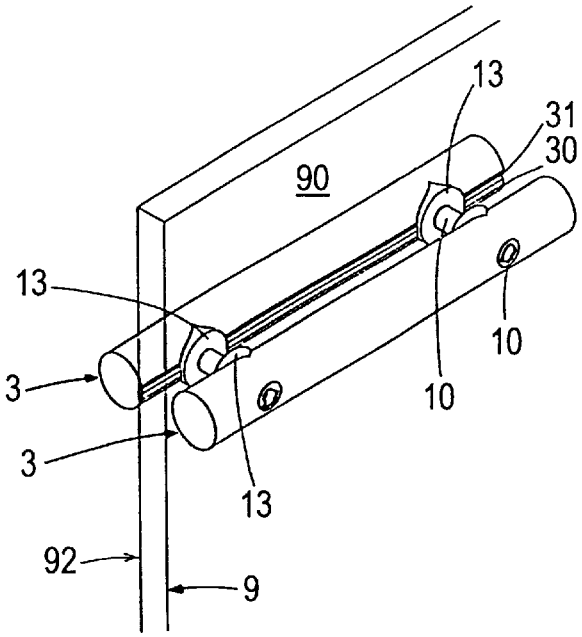
Fig. 9C
Fig. 10
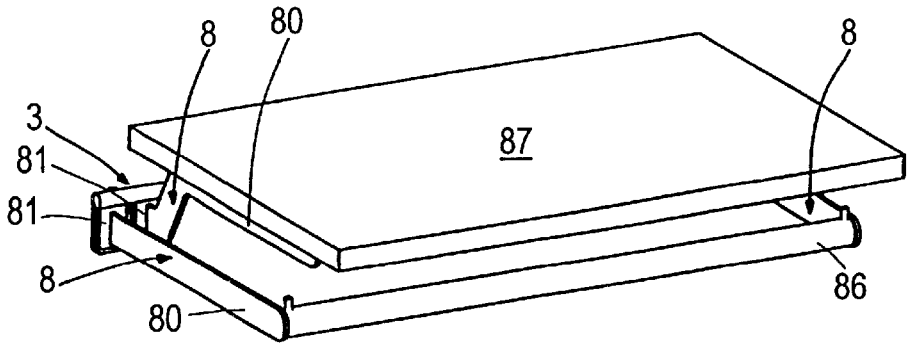

Fig. 11A
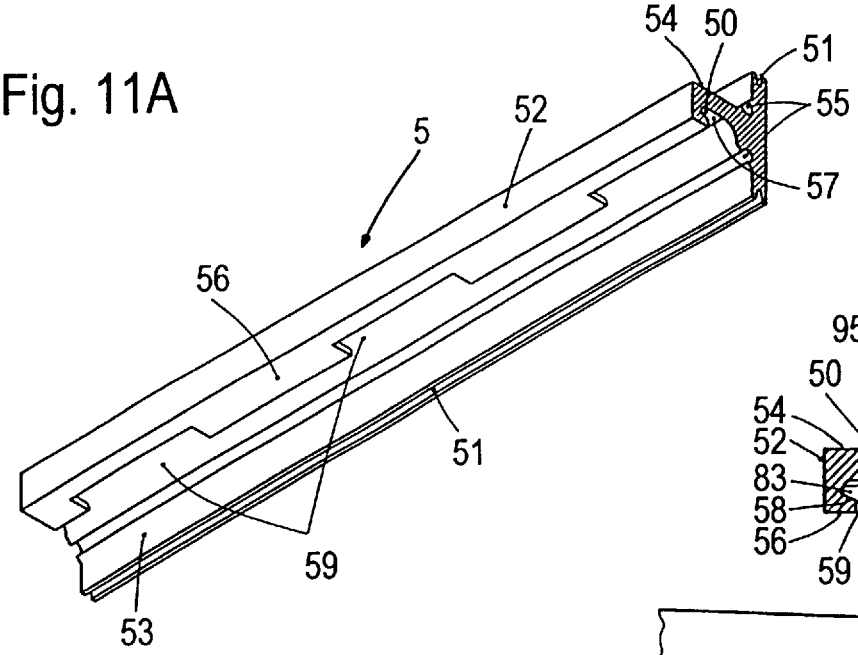
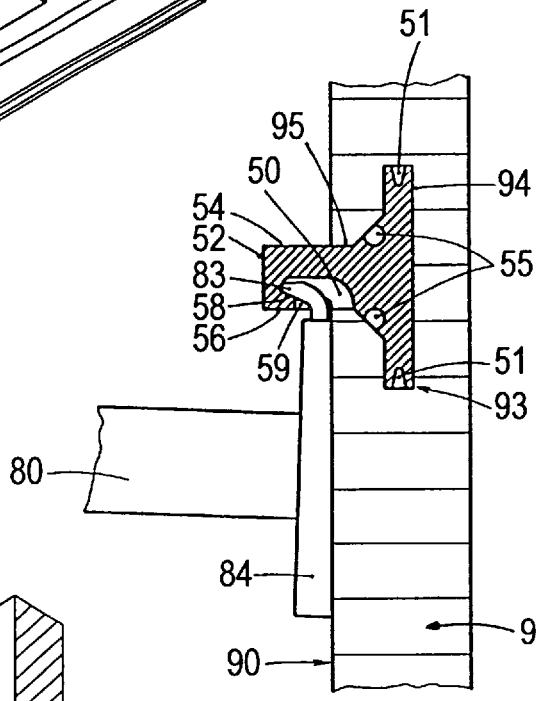
Fig. 11B
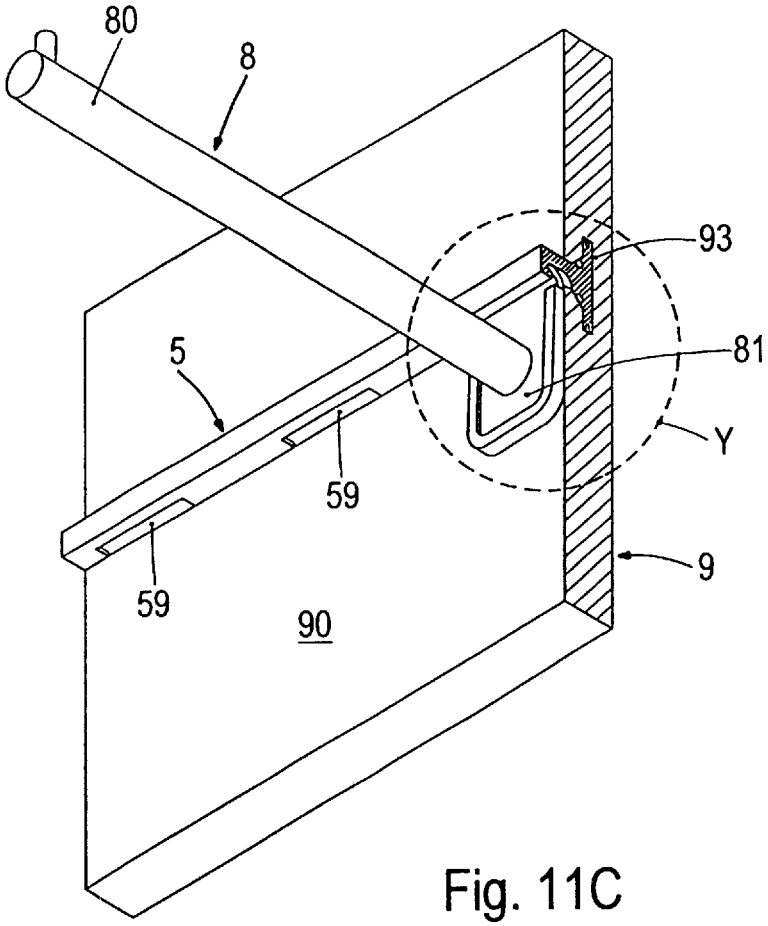
Fig. 11C

Fig. 12A
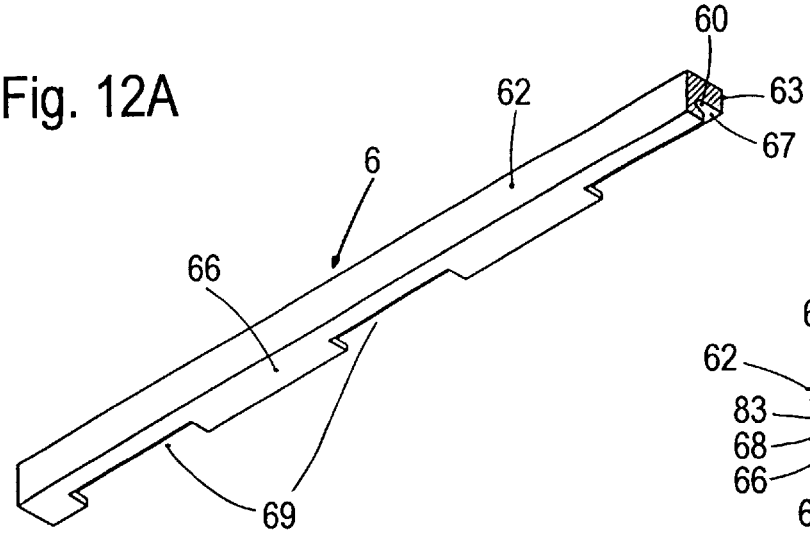
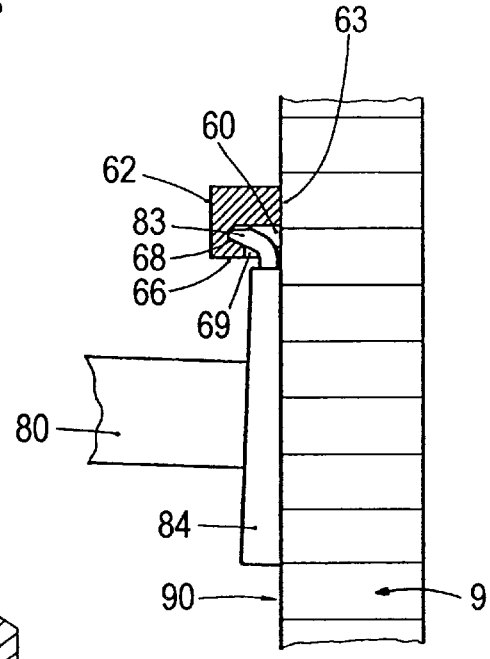
Fig. 12B
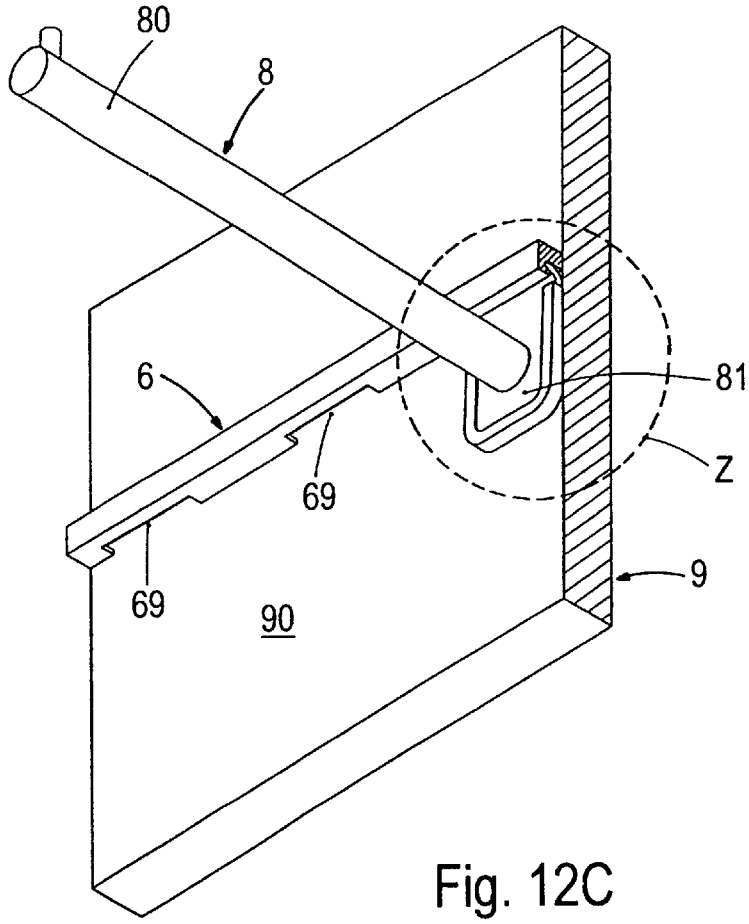
Fig. 12C

DISPLAY DEVICE FOR PRESENTATION OF GOODS

FIELD OF USE OF THE INVENTION

The present invention relates to a display device for the presentation of goods in shops and at exhibitions. The display device comprises a supporting structure, for example a panel, at least one shaped rod fixed horizontally on the supporting structure and supporting arms which can be fitted into this shaped rod. In general, the display device has a plurality of shaped rods which are arranged systematically spaced apart from one another horontally. The supporting arms can be fitted as desired within all selectable positions and serve for the direct or indirect support of the goods to be displayed. A typical use is provided in the clothing sphere where outer clothing garments hanging on hangers are hung onto display devices fitted with supporting arms. Display devices of this type make possible presentation of the offered goods close to the customer, design of the selling areas to be variable and uncomplicated changing of the fitments. Nevertheless, the goods offered can be displayed in an accurate order so that an overall impression which is appropriate for selling prevails at all times.

PRIOR ART

Display devices of the generic types mentioned have already been disclosed in the prior art many times. GB-A-2 241 426 discloses a presentation wall having horizontal, linear plug-in slots which extend obliquely downwards into the rear wall. Hooks in the shape of the number "1", on which a supporting arm protruding into the room is arranged in a fixed manner, are provided for fitting into these slots. A large part of the slot surface, which remains unoccupied, is freely visible, which is not visually advantageous. Furthermore, the load on the individual supporting arm may only be low in order to avoid it breaking off. The devices according to CH-A-650 137 and DE-A-34 38 759 are also based on a rear wall having horizontal grooves into which hooks can be inserted.

GB-A-2 206 033 and GB-A-2 222 070 describe display devices having oval shaped rods onto which supporting arms having hanger parts can be placed.

The shaped rods and hanger parts are relatively bulky components and so these devices do not meet every aesthetic requirement.

FR-A-2 611 468 proposes a device having shaped parts and a supporting arm, the shaped part having a hook edge at the top and the supporting arm having a wire loop which fits into the hook edge. The supporting arm is thus unable to be fitted at every desired position, and edges and loops are visually very conspicuous.

WO-A-91 14388 contains various modifications of display devices having different shaped rails and supporting arms. In this case, either complicated, rough shapes and relatively complex supporting arms are used or the slot surfaces, which for the most part are unoccupied, are externally visible.

OBJECT OF THE INVENTION

In view of the imperfections and limited possibilities of use of the display device existing to date, the invention is based on the problem of providing an improved display device which allows great variability, has a sturdy supporting capability, permits rapid changing around of the equipment, securely supports the goods even when business is brisk and meets diverse, aesthetic requirements. The shaped rods used are to be of the simplest possible cross section, and also the supporting arms are to have an uncomplicated design so that the entire device can be produced inexpensively and can be changed in a flexible manner. If the width of the shaped rod is a multiple of the width of the supporting arms, the latter are to be fitted at any desired horizontal position along a shaped rod—i.e. in an entirely freely selectable manner or within a grid—and then securely mounted. In a design variant, the shaped rods are intended as short pieces to be able to be arranged in a grid shape in lines and rows on a panel. One thing to be avoided is that [lacuna] shaped rods which are not fitted with fitted supporting arms open, irregular slot sections can be visible.

SUMMARY OF THE INVENTION

The display device has at least one elongated, rail-shaped, rod-shaped or tubular shaped rod fastened at least essentially horizontally on a supporting structure and a supporting arm which can be fitted thereon. At one end of the rod part of the supporting arm is attached a plug-in plate perpendicularly or obliquely, protrudes over the upper side of the rod part and has a bevelled edge which points in the axial direction of the rod part and can be split up into two tongues by a central indentation. The supporting arm is fitted onto the shaped rod by raising the free end of the rod part with respect to the horizontal and bringing the bevelled edge from below the shaped rod up to the shaped rod and lowering the free end into the end position after the fitting. In the fitted end position the flat portion of the plug-in plate is supported on the front side of the supporting structure while the bevelled edge rests on an oblique surface on the shaped rod or is inserted into a groove or engages behind and partially over the shaped rod. Six different embodiments have been developed for the shaped rod.

The shaped rods extend either at least approximately entirely over the entire width of a panel so that one or more supporting arms, positioned according to choice, can fit along the individual shaped rod. In a design variant, the shaped rods are designed as short pieces into which only one supporting arm can be fitted. To erect the panel in the room—the panel is accessible from both side surfaces—the two panel surfaces can be fitted with shaped rods and/or shaped-rod pieces. It is advantageous in this case for the shaped rods and/or shaped-rod parts, which in each case lie opposite one another on both sides of the side surfaces, to be connected to one another through the panel.

Suitable supporting arms are all the types known in shop construction, i.e. first of all supporting arms which have a strut which extends horizontally in a bent or angled manner. From a supporting arm having a central strut, on which a plug-in plate is arranged for fitting into the shaped rod, a plurality of further struts can emerge as diverging branches. Between the ends of two supporting rods, which lie opposite the plug-in plates, a transverse rod, which in the fitted state runs parallel to the supporting structure, can be arranged in a fixed manner. The direct goods carrier is then the transverse rod on which, for example, clothes hangers with clothing can be hung, while the supporting rods have the function of brackets. Shelves can be fixed on two or more supporting rods—which likewise function as brackets. With such a variety of types of supporting rods it is possible to fit a plurality of supporting rods onto a shaped rod, the supporting rods themselves, or direct goods carriers fixed thereon, extending in a plurality of horizontal planes. An exemplary arrangement of this type is a transverse rod fixed between two supporting rods and a shelf which is provided above it and is supported by two other supporting rods.

First Embodiment

The shaped rod consists of a round rod which is placed, preferably screwed, horizontally and at a distance onto a supporting structure—for example, a panel surface. Spacer sleeves are placed onto the fastening bolts used to space the round rod apart from the front side of the supporting structure. The rounded bevelled edge on the plug-in plate can be inserted between the round rod and the surface of the supporting structure if the free end of the rod part is raised with respect to the horizontal. After the bevelled edge is inserted, the supporting arm is brought into a horizontal position so that the bevelled edge engages behind the shaped rod and sits partially on it. At the same time, that flat portion of the supporting plate which is situated below the bevelled edge is supported on the front side of the supporting structure.

Second Embodiment

The shaped rod is a linear section of oval-like cross section which is screwed horizontally and at a distance onto the supporting structure. An axially continuous or sectional plug-in groove extends along that surface of the shaped rod which faces the supporting structure. The frontmost portion of the bevelled edge on the plug-in plate can be inserted into the plug-in groove if the free end of the rod part is raised with respect to the horizontal. After the bevelled edge is inserted, the entire supporting arm is again brought into a horizontal position so that the flat portion of the plug-in plate is supported on the front side of the supporting structure. As an option the bevelled edge has an indentation which extends into the flat portion and it is thus possible for the supporting arm to be fitted between the shaped rod and the supporting structure even in the region of a screw connection, the fastening bolt then sitting in the indentation with the spacer sleeve or another thickened portion.

Third Embodiment

Instead of the plug-in groove according to the second embodiment, on that side which faces the front side of the supporting structure the shaped rod has a longitudinal oblique surface onto which the bevelled edge of the plug-in plate is placed if a supporting arm is fitted. The oblique surface ascends in the direction of the rod part and in its angle of ascent is complementary to the angle of the bevelled edge.

Fourth Embodiment

The shaped rod is a T-section whose base limb is placed horizontally onto a supporting structure or is inserted laterally into a T-groove incorporated horizontally in the supporting structure, with the result that the free portion of the central limb of the shaped rod extends from the front side of the supporting structure into the room. The central limb has a systematic slotted grid which remains accessible even with the shaped rod inserted in it. The bevelled edge on the plug-in plate can be inserted through any selected slot in the slotted grid if the free end of the rod part of the supporting arm is raised with respect to the horizontal. After the bevelled edge is inserted through into a selected slot, the entire supporting arm is brought back into a horizontal position so that the bevelled edge rests on the upper side of the central limb and the flat portion of the plug-in plate is supported on the front side of the supporting structure.

Fifth Embodiment

Instead of the slotted grid according to the fourth embodiment, on the underside of the central limb the shaped rod has a longitudinal groove which ascends obliquely towards the free outer edge and into which the bevelled edge of the plug-in plate penetrates if a supporting arm is fitted. The angle of ascent of the groove is complementary to the angle of ascent of the bevelled edge. In a first submodification, the shaped rod is inserted into the supporting structure only to such a depth and the entrance opening of the groove is positioned and dimensioned in such a manner that the entrance opening is accessible over the entire length of the shaped rod, i.e. supporting arms can be fitted at any position along the shaped rod.

In a second submodification, when the shaped rod is inserted into the supporting structure the entrance opening of the groove is closed. The section surrounds the underside of the groove sufficiently far for it to reach up to the surface of the supporting structure. The entrance opening thus lies concealed within the T-groove in the supporting structure into which the shaped rod is inserted. To provide a grid having defined fitting positions, sections of the underside of the central limb of the shaped rod are provided with clearances, as a result of which the entrance openings are widened in the region of the clearances and supporting arms can only be fitted here.

Sixth Embodiment

This shaped rod having a rectangular or square cross section is placed as a whole by its rear placing-on edge onto the supporting structure. The fastening is preferably done by screwing. The groove begins at the placing-on edge, extends axially along the shaped rod ascending obliquely in the direction of the front edge. The fitting positions, which are spaced apart within the grid, for the supporting arms are formed by clearances, provided systematically in sections on the underside of the shaped rod, over the width of the plug-in plate of the supporting arm. A respective supporting arm can only be fitted into a shaped rod placed onto the supporting structure at the positions of the clearances. Outside the clearances the section surrounds the underside of the groove that it is placed on the supporting structure at least virtually without a gap.

Seventh Embodiment

This shaped rod has similarity with the fifth embodiment. The front edge of the central limb of the shaped rod projects here also from the supporting structure and the groove for fitting in the supporting arms is accessible from below. The shaped rod is inserted between two plates having grooves at their longitudinal edges, into which grooves the vertical base limb engages of the shaped rod, as it were like a connecting tongue. A back portion of the shaped rod overlapping both plate edges lies on the rear side of the supporting structure. The back portion serves for supporting of the added plates and eventually for direct fastening at a wall or for connecting with vertical counterbrackets. A slotted grid running along the supporting structure is provided at the section of the central limb projecting forward from the supporting structure, so that—complementary to the supporting arms insertable from below—additional insertable hanger arms can be fitted in from above into the shaped rod.

BRIEF DESCRIPTION OF THE ATTACHED DRAWINGS

Figure 4B:
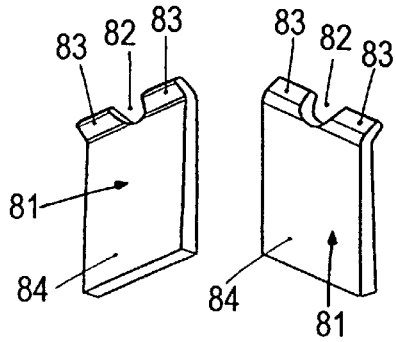
Figure 3B:
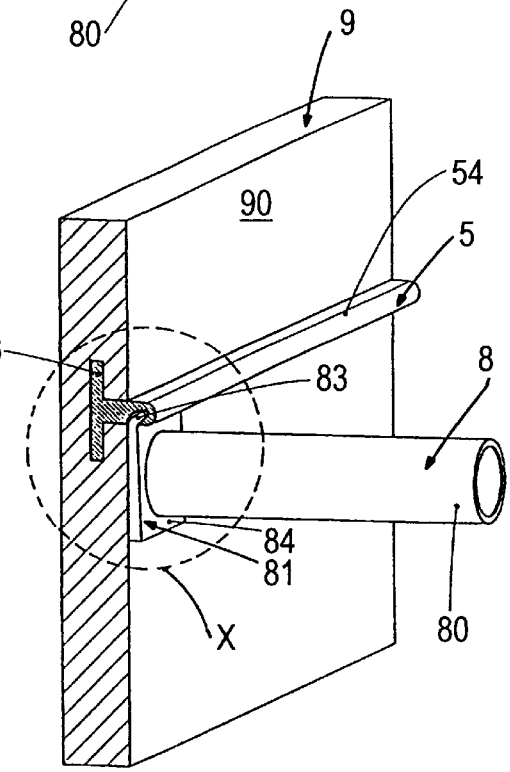
Figure 4A:
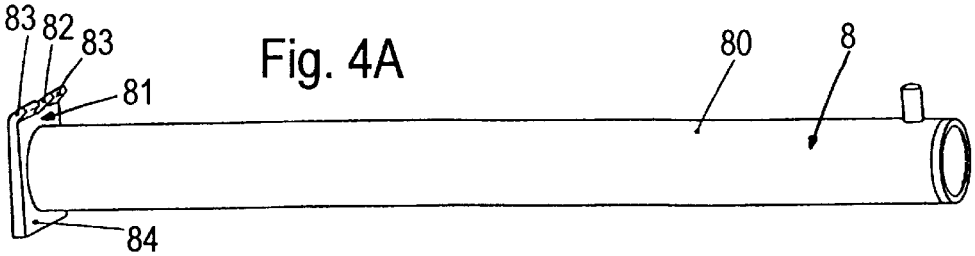
Figure 6B:
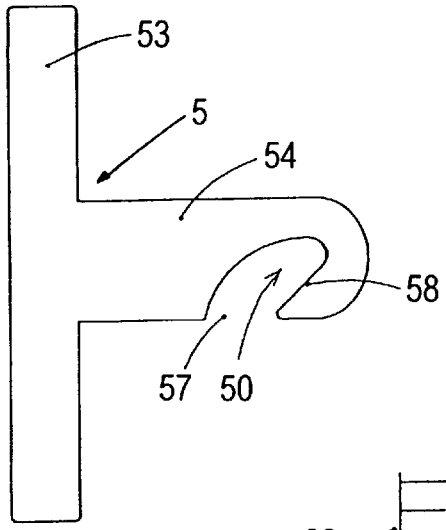
Figure 7A:
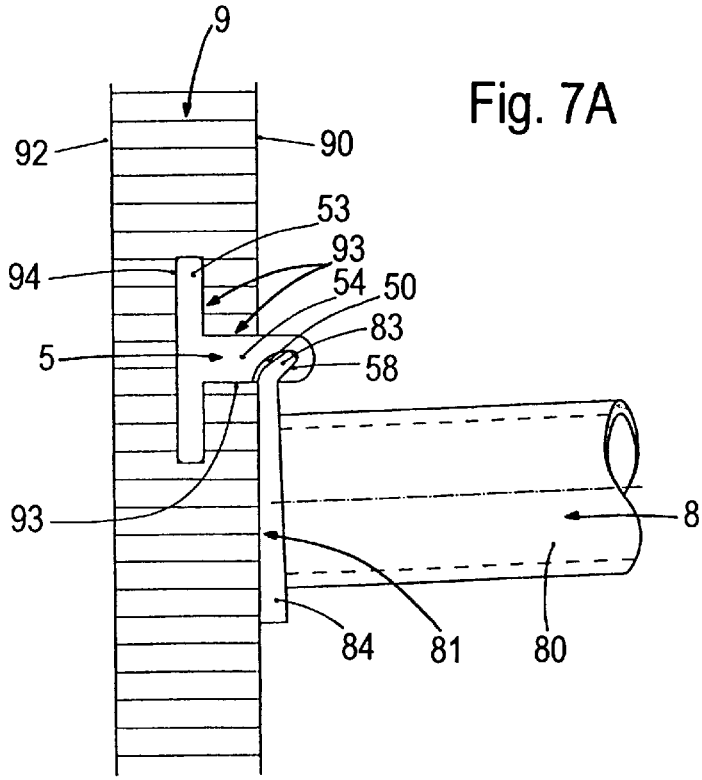
Figure 7B:
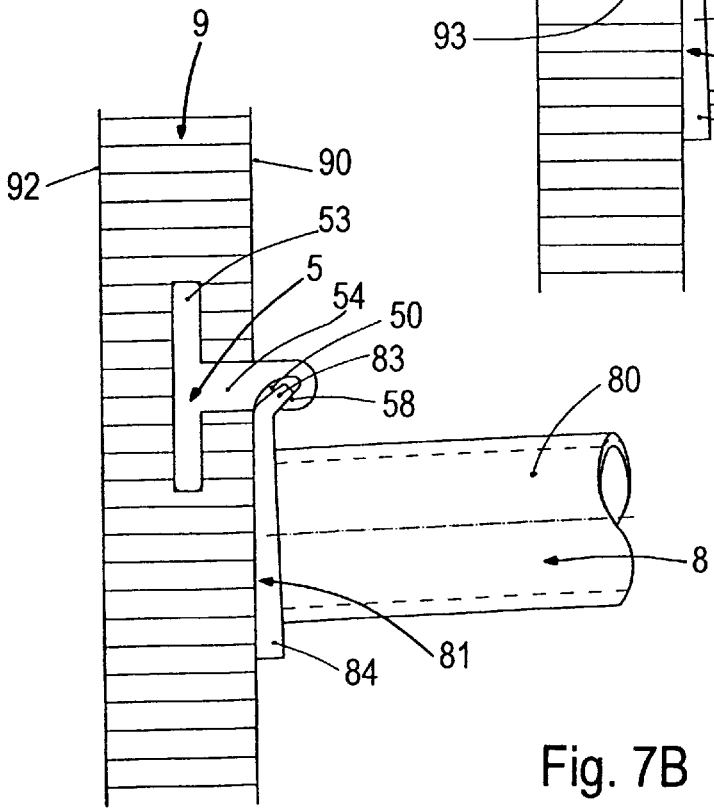
Figure 8A:
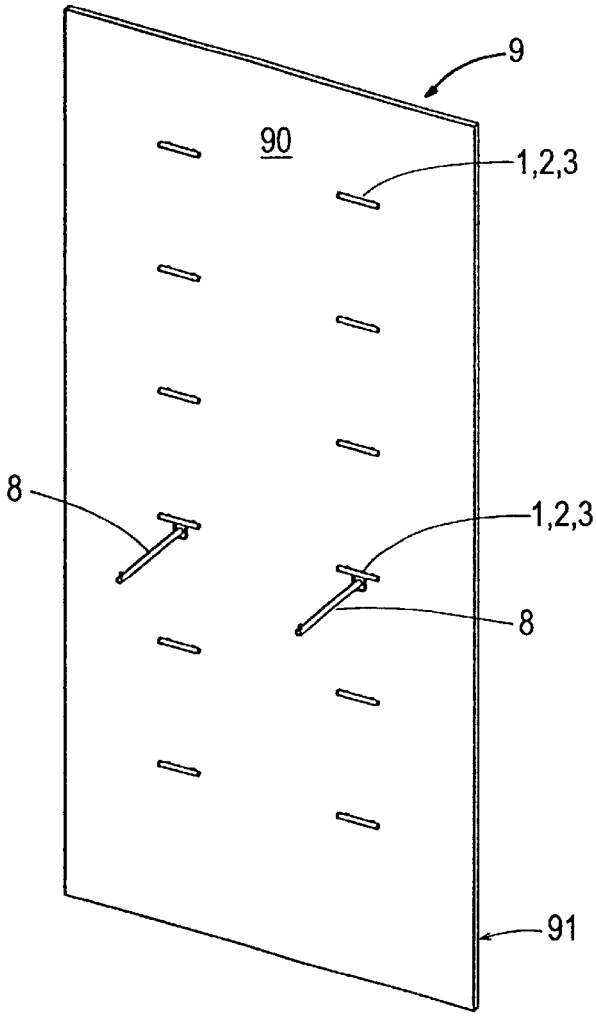
Figure 9A:
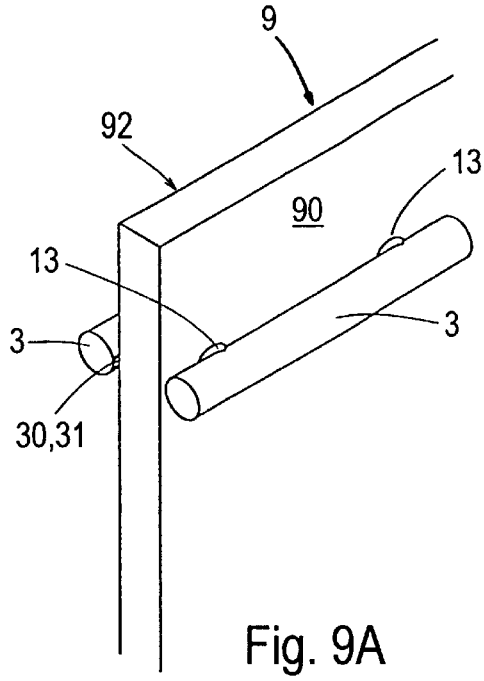
Figure 8B:
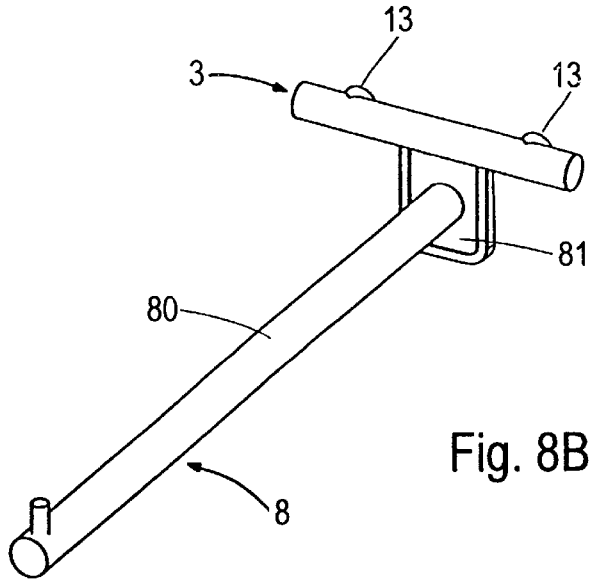
Figure 13A:
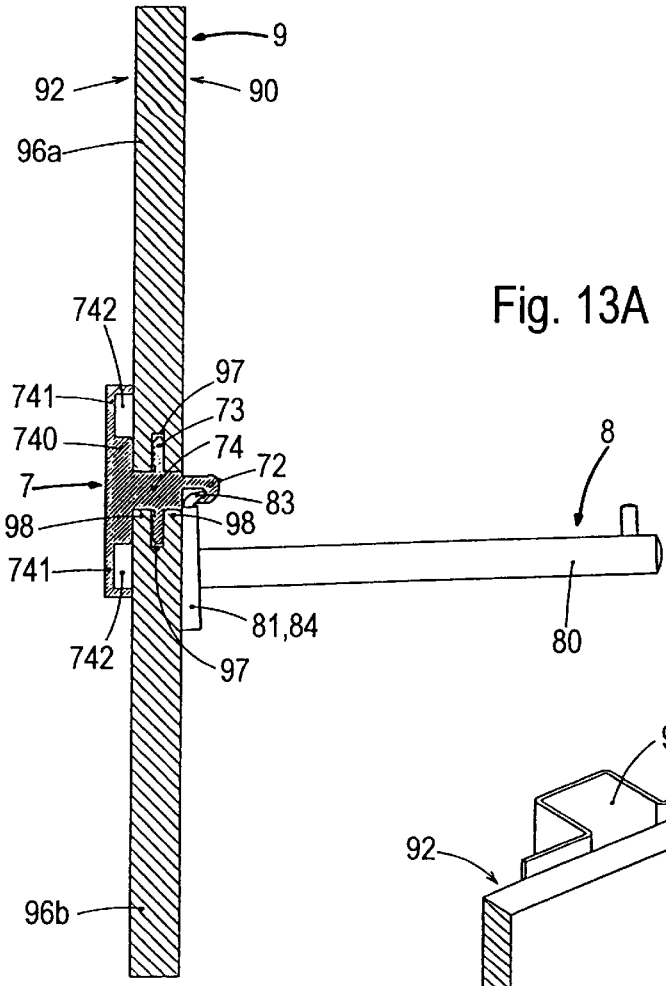
Figure 13B:
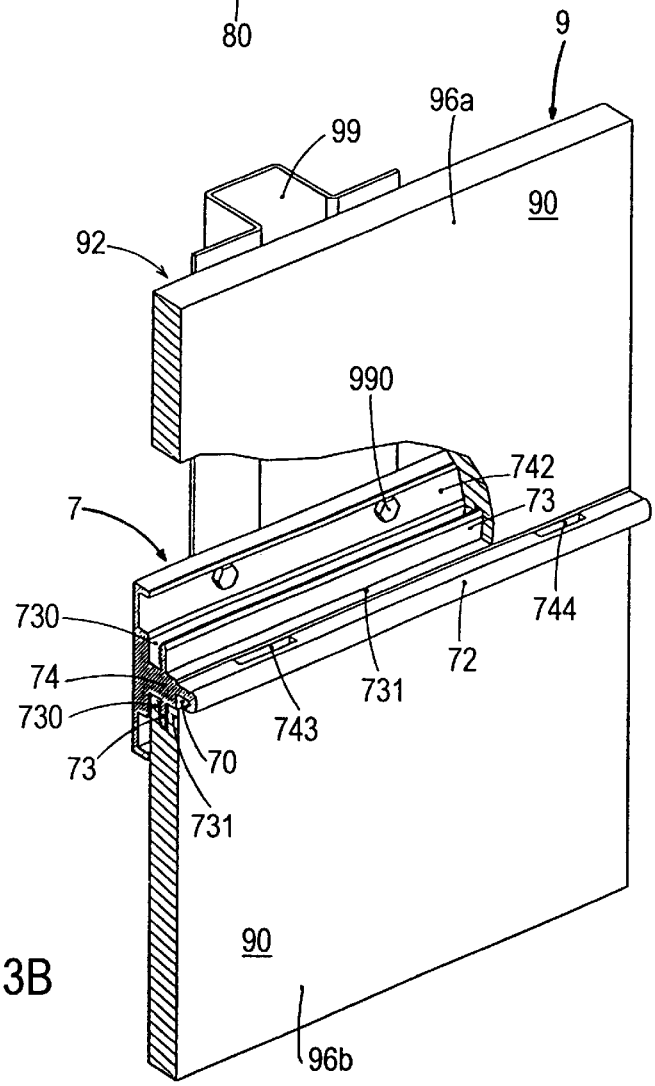
Figure 13C:
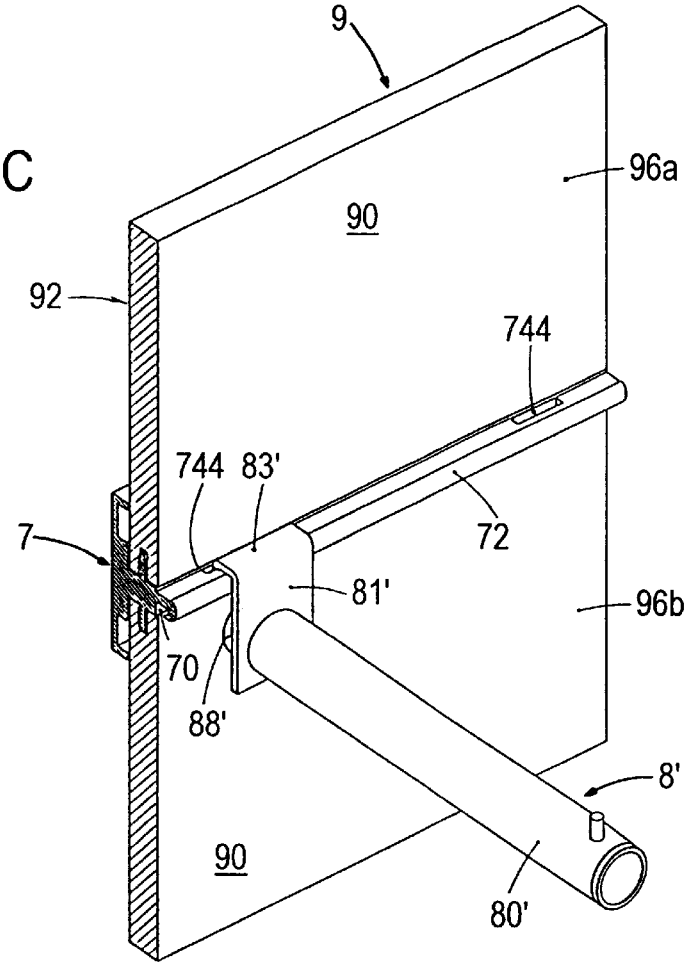
Figure 13D:
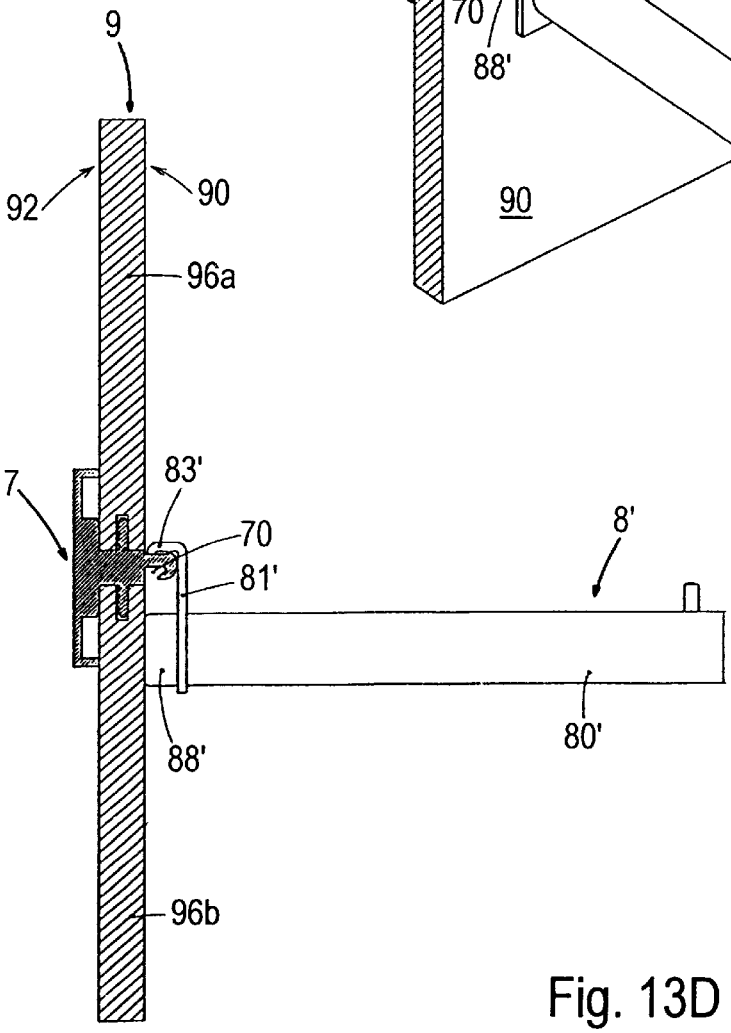
Figures 13E, 13F:
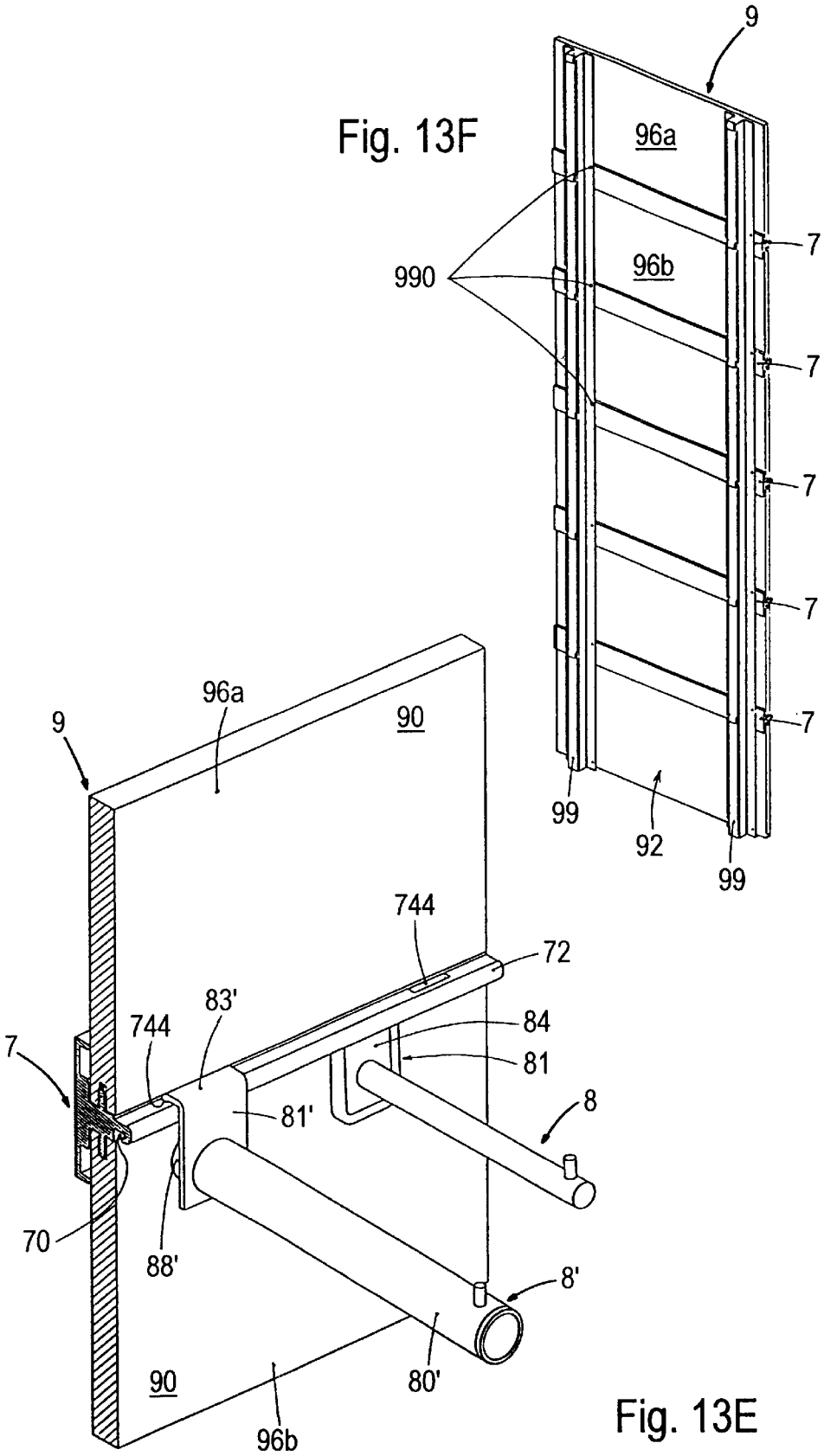

The drawing show the following:

FIG. 1A—a panel section having shaped rods placed on it and carrier arms fitted on a shaped rod, as a schematic illustration;

FIG. 1B—a panel section having inserted shaped rods and carrier arms fitted on a shaped rod, as a schematic illustration;

FIG. 2A—a first embodiment of the display device having a shaped rod in the form of a round rod placed onto a supporting structure, as a partial section;

FIG. 2B—a second embodiment of the display device having a shaped rod which is placed onto a supporting structure and has an axial plug-in groove, as a partial section;

FIG. 2C—a third embodiment of the display device having a shaped rod which is placed onto a supporting structure and has an axial groove contour, as a partial section;

FIG. 2D—a wall section having the display device of the third embodiment according to FIG. 2C, as a perspective illustration;

FIG. 3A—a fourth embodiment of the display device having a shaped rod in the form of a T-section which is inserted into a supporting structure and has an axial slotted grid, as a partial section;

FIG. 3B—a fifth embodiment of the display device in the first submodification having a shaped rod in the form of a T-section which is inserted into supporting structure and has an axial plug-in groove, as a partial section;

FIG. 3C—a wall section having the display device of the fifth embodiment according to FIG. 3B, as a perspective illustration;

FIG. 4A—a supporting arm having a rod part and the plug-in plate put onto it at the front, as a schematic illustration;

FIG. 4B—the plug-in plate according to FIG. 4A, in two perspective views;

FIG. 5A—an entire shaped rod of the third embodiment according to FIG. 2C as a perspective illustration;

FIG. 5B—the shaped rod according to FIGS. 2C and 5A, in a vertical cross section;

FIG. 5C—the shaped rod according to FIG. 5A in engagement with a supporting arm, as a perspective illustration;

FIG. 6A—an entire shaped rod of the fifth embodiment in the first submodification according to FIG. 3B, as a perspective illustration;

FIG. 6B—the shaped rod according to FIGS. 3B and 6A, in a vertical cross section;

FIG. 7A—the detail X from FIG. 3B at maximum insertion depth of the shaped rod;

FIG. 7B—the detail X from FIG. 3B at minimum insertion depth of the shaped rod;

FIG. 8A—panel having short shaped-rod pieces placed on it in lines and rows and carrier arms fitted onto two shaped-rod pieces, as a schematic illustration;

FIG. 8B—a shaped-rod piece having a fitted carrier arm, as a perspective illustration;

FIG. 9A—a panel corner having shaped-rod pieces arranged on both sides of the panel;

FIG. 9B—the panel corner according to FIG. 9A having the shaped-rod pieces, in an exploded illustration;

FIG. 9C—the panel corner according to FIG. 9A having the fitted shaped-rod pieces, in a transparent illustration;

FIG. 10—a shaped rod having fitted supporting arms which extend in two horizontal planes lying one above another;

FIG. 11A—an entire shaped rod of the fifth embodiment according to FIGS. 3B and 6A as a second submodification having systematic clearances on the underside of the central limb, as a perspective illustration;

FIG. 11B—the detail Y from FIG. 11C;

FIG. 11C—the shaped rod according to FIG. 11A inserted into a supporting structure and having a fitted supporting arm;

FIG. 12A—an entire shaped rod of the sixth embodiment, as a perspective illustration;

FIG. 12B—the detail Z from FIG. 12C;

FIG. 12C—the shaped rod according to FIG. 12A inserted into a supporting structure and having a fitted supporting arm;

FIG. 13A—a shaped rod of the seventh embodiment within a panel with a fitted supporting arm, in a vertical partial section;

FIG. 13B—the shaped rod according to FIG. 13A within a panel with a vertical counterbracket at the rear side of the panel, in a perspective partial section;

FIG. 13C—the shaped rod according to FIG. 13A within a panel with a hanger arm, in a perspective partial section;

FIG. 13D—the illustration according to FIG. 13C with a hanger arm, in a vertical partial section;

FIG. 13E—the illustration according to FIG. 13C with a fitted supporting arm and an additional hanger arm, in a vertical partial section; and FIG. 13F—an entire panel with several shaped rods according to FIG. 13A with counterbrackets on the rear side of the supporting structure, in a perspective illustration.

EXEMPLARY EMBODIMENTS

The detailed description of exemplary embodiments of the display device according to the invention is given below with reference to the attached drawings, possible modifications being mentioned at the end.

FIG. 1A

Shaped rods 1,2,3 are placed onto a supporting structure 9, first and foremost a panel section, horizontally, systematically and spaced apart parallel to one another. The shaped rods 1,2,3 are intended for the fitting of supporting arms 8. In this case, by way of example, two supporting arms 8 whose rod parts 80 protrude into the room are fitted on a shaped rod 1,2,3 arranged at central height. The rod parts 80 are provided for the direct or indirect mounting of the goods to be presented, for example for hanging of items of clothing which are hanging on hangers. As is customary in the construction of shops and trade fairs, the panel section will have a defined grid dimension, and a plurality of panel sections can be joined to one another to form a wall.

The following statement applies to all the rest of the description. If reference numbers are contained in a figure for the purpose of unambiguity in the drawings but are not explained in the immediately associated text of the description, reference is made to where they are mentioned in the preceding or following descriptions of the figures. In the interests of clarity, the repeated indication of components in further figures is largely avoided as long as it can be seen unambiguously in the drawing that these are "recurring" components.

FIG. 1B

The display device of this figure essentially corresponds to the display device according to FIG. 1A; only the design of the shaped rods 4,5 and their attachment are different. The shaped rods 4,5 which are arranged horizontally, systematically and spaced apart parallel to one another are inserted into the supporting structure 9—which here is also a panel section. The shaped rods 4,5 too are also intended for the fitting of supporting arms 8 and their rod parts 80, which protrude into the room, are used for mounting the goods to be displayed.

FIG. 2A

In the first embodiment of the display device the shaped rod 1, which is placed onto the front side 90 of the supporting structure 9, has a round cross section. A plurality of bolts 10 which lie in a plane and protrude through through-holes 91 present in the supporting structure 9 extend perpendicularly from the longitudinal axis of the shaped rod 1. An external thread 12 is preferably provided on the free bolt end 11 so that a nut (not shown) can be screwed from the rear side 92 of the supporting structure 9 onto the protruding-through bolt end 11 for the purpose of fastening the shaped rod 1. Arranged opposite the free bolt end 11 is a thickened portion 13 which results in an annular shoulder 14 facing the free bolt end 11. The thickened portion 13 can be produced by a corresponding design of the bolt 10 or by a spacer sleeve pushed onto the bolt 10. The shoulder 14 has a larger external diameter than the through-hole 91 and is therefore placed on the front side 90 of the supporting structure 9 so that the shaped rod 1 is fixed with respect to the front side 90 at a gap spacing S.

A supporting arm 8 with the plug-in plate 81 attached perpendicularly at the front to the rod part 80 can be fitted both on the shaped rod 1 between two bolts 10 and also in a manner such that it surrounds a bolt 10. The surrounding of a bolt 10—logically in the region of the thickened portion 13—is made possible by the indentation 82 which is present in the plug-in plate 81 and extends centrally downwards from the upper edge 85 of the plug-in plate 81. Two tongues 83 which are bent in the direction of the rod part 80 in a manner complementary to the external rounding of the shaped rod 1 are produced on either side of the indentation 82. The plug-in plate 81 protrudes at least upwards over the external diameter of the placed-on rod part 80 so that in the fitted state the shaped rod 1 does not collide with the rod part 80. The plug-in plate 81 is situated, as it were, within the gap spacing S, the two tongues 83 engaging behind the shaped rod 1 and being supported on the upper side 15 of the cross-sectionally circular shaped rod 1. The fitting of the supporting arm 8 is only possible if the rod part 80 is raised at the free end with respect to the horizontal; only in this manner can the bent tongues 83 be pushed through the gap spacing S. After the tongues 83 are introduced, the supporting arm 8 is again brought into a horizontal position. The tongues 83 which are supported on the upper side 15 of the shaped rod 1 prevent the fitted supporting arm 8 from falling down. If the supporting arm 8 is to be removed, the free end of the rod part 80 has to be raised beforehand. The inherent weight of the supporting arm 8 causes those surfaces of the tongues 83 which are in contact with the shaped rod 1 to press against the latter. At the same time, that flat portion 84 of the plug-in plate 81 which is situated below the tongues 83 is supported on the front side 90 of the supporting structure 9. With an increasing load on the supporting arm 8, the pressing of the tongues 83 onto the shaped rod 1 increases and, at the same time, the pressing of the flat portion 84 onto the front side 90 is reinforced, in accordance with the lever principle.

FIG. 2B

The second embodiment is different from the preceding figure only with regard to the cross section of the shaped rod 2, a plug-in groove 20 provided therein, the bending of the tongues 83 and the engagement of the tongues 83 into the plug-in groove 20. The shaped rod 2 has an oval cross section in principle, but only constitutes an alternative to the round shaped rod 1 and is otherwise insignificant. The shaped rod 2 could also have a round cross section. The essential feature is the axial plug-in groove 20 which faces the front side 90, runs along the shaped rod 2 and extends horizontally into the shaped rod 2. The indentation 82 on the plug-in plate 81 is less deep and the bending radius in which the tongues 83 are turned towards the rod part is smaller. In this case, the tongues 83 are in principle bent away at right angles so that the tapering-off parts of the tongues 83 have a horizontal alignment.

In the fitted state the plug-in plate 81 is again situated in the gap spacing S, the thickened portion 13 of the bolt 10 coming to lie in the indentation 82 and the horizontal tapering-off parts of the tongue 83 sitting in the plug-in groove 20. In this case too the free end of the rod part 80 has to be raised in order to be able to introduce the tongues 83 of the plug-in plate 81, arranged in a fixed manner at one end on the rod part 80, into the plug-in groove 20. The flat portion 84 of the plug-in plate 81 is pressed against the front side 90 of the supporting structure 9 by the inherent weight of the supporting arm 8, and reinforced in the event of the supporting arm 8 being loaded, while the tongues 83 sit all the more firmly in the plug-in groove 20. The removal of the supporting arm 8 takes place in a reverse manner so the free end of the rod part 80 has first to be raised in order to disengage the tongues 83 from the plug-in groove 20. After this, the tongues 83 can be pulled out of the gap spacing S and the supporting arm removed.

FIGS. 2C, 2D and 4A to 5C

The third embodiment again has a cross-sectionally differently contoured shaped rod 3 and different bending of the tongues 83. The shaped rod 3 is approximately oval in cross section and on the side which faces the front side 90 of the supporting structure 9 has at least one oblique surface 30 which extends longitudinally axially of the shaped rod 3 and ascends from the lower half of the shaped rod 3 towards the horizontal central axis M of the shaped rod 3 at a pitch angle $\alpha$. A further oblique surface 31 is preferably provided, this surface descending from the upper half of the shaped rod 3 towards the horizontal central axis M of the shaped rod 3 at a pitch angle $\alpha$. Only the lower oblique surface 30 is required for the fitting of the supporting arms 8. The symmetrical arrangement of the oblique surfaces 30,31 makes it possible also to place the shaped rod 3 turned through 180° onto the front side 90 of the supporting structure 9 so that then the oblique surface 31 which beforehand is situated at the top comes to lie at the bottom. This simplifies the assembly since—with a symmetrical arrangement of the bolts 10—attention does not have to be paid to the position to which the shaped rod 3 has turned.

The tongues 83 on the plug-in plate 81 on either side of the indentation 82 are bent in the direction of the rod part 80 in a complementary manner to the pitch angle $\alpha$ and are of a height which corresponds to the width of the oblique surfaces 30,31. In the fitted state the thickened portion 13 of the bolts 10 is seated within the indentation 82 and the plug-in plate 81 is situated in the gap spacing S, i.e. the angled tongues 83 engage behind the shaped rod 3 and rest on that oblique surface 30 or 31 which in each case is situated at the bottom. A plurality of systematically distributed bolts 10 which can be inserted into complementary through-holes 91 are provided for sturdily fastening the shaped rod 3. Supporting arms 8 can also be fitted outside the bolts 10; in the event of positioning of this type, the indentations 82 remain unoccupied. Supporting arms 8 which are subjected to a particularly heavy load are preferably fitted in the region of a bolt 10 since the device has the best supporting capability at that point. As already described for the previous embodiments, in this case too fitting and removal of a supporting arm 8 require the free end of the rod part 80 to be raised.

FIG. 3A

The fourth embodiment now introduced differs clearly from the embodiments dealt with up to now. The shaped rod 4 has a T-section in cross section, with a base limb 43 and a central limb 44 placed centrally and perpendicularly on it. A slotted grid 40 which runs along the central limb 44 and has slots 42 arranged systematically in a row is provided near to the free outer edge of the central limb 44. For fixing the shaped rod 4 on the supporting structure 9 a T-groove 93—consisting of a vertical section 94 and a horizontal section 95 emerging on the front side 90—is incorporated into said supporting structure. The vertical section 94 serves for receiving the base limb 43 of the shaped rod 4 and the central limb 44 comes to lie in the horizontal section 95, the central limb 44 protruding out of the front side 90 so that the slotted grid 40, which is at a distance of a gap spacing S from the front side 90, is accessible for the fitting of the tongue 83 of the plug-in plate 81 into any desired slot 42.

It may be sensible to provide two tongues 83, which are produced by an indentation 82 lying in between them, in order also to be able to use the supporting arm 8 for the device according to FIG. 2B. Otherwise, the indentation 82 in the plug-in plate 81 is not required in the fourth embodiment since there is no bolt 10 to surround. The bending of the tongue 83 is identical to the design according to FIG. 2A. In the fitted state the tongue 83 protrudes through a slot 42—depending on the selected positioning of the supporting arm 8—and is supported on the upper side 45 of the central limb 44, towards its outer edge. Here too, without any alteration, the fitting and removal of a supporting arm 8 require the free end of the rod part 80 to be raised. As in all the previous embodiments, in the fitted state the flat portion 84 of the plug-in plate 81 is supported on the front side 90 of the supporting structure 9. The T-groove 93 could preferably be made by milling and the shaped rod 4 inserted by being pushed laterally into the T-groove 93.

FIGS. 3B, 3C and 6A

The fifth embodiment of the display device is likewise based on a shaped rod 5 having the cross section of a T-section with a base limb 53 and a central limb 54 placed centrally and perpendicularly thereon. The base limb 53 is again embedded in the vertical section 94 of a T-groove 93 while the central limb 54 sits in the horizontal section 95 of said groove, the central limb 54 protruding out of the front side 90 of the supporting structure 9. The underside 56 of the central limb 54 is provided with a groove 50 which ascends obliquely in the direction of the free outer edge of the central limb 54, extends along the shaped rod 5 and when in use remains accessible. When a supporting arm 8 is being fitted, this groove 50 serves to receive the tongue 83 which is bent in accordance with the third embodiment (cf. FIGS. 2C, 4A and 5C). If an indentation 82 is again provided in the plug-in plate 81, supporting arms 8 which are fitted in this manner can also be fitted into shaped rods 3 of the third embodiment. The kinematic sequences during the fitting and removal are identical to the examples already described.

FIGS. 6B to 7B

The plug-in plate 81 has an increasing thickness from the tongues 83 towards the flat portion 84 so that the rod part 80 of a fitted supporting arm 8 has a slight ascent into the room. This is used to avoid a visually annoying downwards tendency of the fitted supporting arms 8 and to compensate in advance for a downwards bending at high load.

The groove 50 has a widened entrance opening 57, a minimum depth to receive at least the substantial part of the length of the tongues 83 and an oblique surface 58 which faces the outer edge of the central limb 54 and on which in the fitted state the tongues 83 come to rest. These design features have the effect of compensating, in particular, for dimensional tolerances between the vertical section 94 and front side 90. According to FIG. 7A, the front side 90 protrudes over the entrance opening 57. As a result, the inserted plug-in plate 81 lies closer to the outer edge of the central limb 54, the tongues 83 are pushed along the oblique surface 58 deeper into the groove 50 and the supporting arm 8 is as a whole positioned higher. As FIG. 7B shows, the front side 90 extends as far as the entrance opening 57. As a result, the inserted plug-in plate 81 lies further away from the outer edge of the central limb 54, the tongues 83 are pushed along the oblique surface 58 less deeply into the groove 50 and the supporting arm 8 is as a whole positioned lower.

FIG. 8A

In this design variant the shaped rods 1,2,3 are divided into short pieces and arranged in a grid shape on the front side 90 of the supporting structure 9 in lines—here, for example, six—and rows—here, for example, two. A supporting arm 8 can be fitted into the individual piece of a shaped rod 1,2,3 in a fixed position.

FIG. 8B

In an advantageous design variant the shaped-rod pieces 3 have a circular cross section and, facing the supporting structure 9, have the oblique surfaces 30,31 (see FIG. 9B). The tongues 83 of the plug-in plate 81 of the supporting arm 8 can again be fitted into an oblique surface 30,31. The thickened portions 13, which serve for the placing onto the supporting structure 9 and for the engagement of a fastening element—for example a screw—are provided, likewise facing the supporting structure 9, on the shaped-rod piece 3. The spacing of the thickened portions 13 is dimensioned such that the plug-in plate 81 can be fitted in between. The indentation 82, which divides the tongues 83 on the plug-in plate 81, would thus be able to be omitted. If the indentation 82 remains and the shaped-rod piece 3 protrudes sufficiently over the thickened portions 13, the supporting arm 8 can be fitted into three different positions, namely between the two thickened portions 13 or with the indentation 82 in each case surrounding a thickened portion 13. For the attachment of the shaped-rod piece 3 on the front side 90 of the supporting structure 9, the thickened portions 13 have internally threaded holes so that fastening screws can be screwed in through the supporting structure 9 from the rear side 92 of the supporting structure 9. Other connecting techniques, such as pinning together, riveting, wedging or bonding, which are familiar to the expert, are suitable for fastening a shaped-rod piece 3 on the supporting structure 9.

FIGS. 9A to 9C

For the erection of a supporting structure 9, which is fitted with shaped-rod pieces 3, in the room, the shaped-rod pieces 3 are arranged in pairs lying opposite one another on the front side 90 and the rear side 92. The thickened portions 13 and the oblique surfaces 30,31 point in this case towards the front side 90 or respectively towards the rear side 92 of the supporting structure 9. The two opposite shaped-rod pieces 3 are most practicably fastened by means of screws 10 which engage into the two shaped-rod pieces 3 through through-holes 91 provided in the supporting structure 9. For this purpose, in that shaped-rod piece 3 which is situated on the rear side 92 the thickened portion 13 in each case has internally threaded holes while that shaped-rod piece 3 which is situated on the front side 90 has through-holes which extend through the thickened portions 13 with a screw fit.

FIG. 10

Two spaced-apart supporting arms 8 with the plug-in plates 81 arranged on them are fitted into a shaped rod 3 which is placed horizontally onto a supporting structure 9 which is not shown here. The rod parts 80 extend straight into the room from the plug-in plates 81. Between those ends of the rod parts 80 which are free there is fixedly arranged a transverse rod 86 which thus runs parallel to the supporting structure 9. Between the two supporting arms 8 for the transverse rod 86, two further supporting arms 8 are fitted with their plug-in plates 81 into the shaped rod 3. These supporting arms 8 have upwardly angled rod parts 80 onto which a shelf 87 is placed. In the example shown, the plug-in plates 81 of the supporting arms 8 for the transverse rod 86 and for the shelf 87 sit closely next to one another. By virtue of the upwardly pointing angling of the rod parts 80 which support the shelf 87, the shelf 87 comes to lie in a horizontal plane above the transverse rod 86 thus resulting in a combination of transverse rod 86 and shelf 87 arranged one above the other. The transverse rod 86 can be used, for example, for hanging up outer clothing with the sleeves showing while articles matching the clothing are placed on the shelf 87 above it.

FIGS. 11A to 11C

The second submodification of the fifth embodiment of the display device likewise uses a shaped rod 5 having the cross section of a T-section and has a base limb 53 and also a central limb 54 placed centrally and perpendicularly on it. The base limb 53 is embedded in the vertical section 94 of the T-groove 93 and the central limb 54 sits in the horizontal section 95 of said groove, the central limb protruding out of the front side 90 of the supporting structure 9. The groove 50 which ascends obliquely in the direction of the free front edge 52 of the central limb 54 and extends along the shaped rod 5 begins at the entrance opening 57 on the underside 56 of the central limb 54. The oblique surface 58 is produced on the inside as a result. To provide a grid having defined fitting positions for the supporting arms 8 to be fitted, sections of the underside 56 of the central limb 54 of the shaped rod 5 are provided with systematic clearances 59 over the width of the plug-in plate 81 of the supporting arm 8. If the shaped rod 5 is inserted into the supporting structure 9, a supporting arm 8 can only be fitted in the region of a particular clearance 59. Outside the clearances 59, the section surrounds the underside 56 of the groove 50 to such an extent that it is placed on the front side 90 of the supporting structure 9 in a manner which is as free as possible from gaps.

Axially extending channels 51 are provided on the upper and lower edge of the base limb 53 on the shaped rod. When adhesive is introduced into the channels 51 the shaped rod 5 can be fixed economically in the T-groove 93. Axially extending flutes 55 are situated at the transition from the central limb 54 to the base limb 53. If two ends of shaped rods 5 collide together in a T-groove 93, the ends can be connected by means of cylindrical pins inserted into the flutes 55. The shaped rods 5 are generally arranged over the entire width of a supporting structure 9, however, it is also possible—depending on the design concept—for only subsections to be fitted. The supporting arm 8 with the rod part 80 and the plug-in plate 81 which has the tongue 83 and the flat portion 84, is unchanged.

FIGS. 12A to 12C

The sixth embodiment of the shaped rod 6 is placed as a whole by its rear placing-on edge 63 onto the supporting structure 9, the fastening preferably being done by screwing. It is thereby possible for the base limb 53 to be omitted, as compared with the embodiment according to FIG. 11A, so that the shaped rod 6 has a rectangular or square cross section, otherwise the shaped rod 6 is based on the same design principle.

The groove 60 begins at the entrance opening 67 on the placing-on edge 63, extends ascending obliquely in the direction of the front edge 62 and axially along the shaped rod 6. The oblique surface 68 is thereby produced on the inside. To provide a grid having defined fitting positions for the supporting arms 8 to be fitted, sections of the underside 66 of the shaped rod 6 are provided with systematic clearances 69 over the width of the plug-in plate 81 of the supporting arm 8. If the shaped rod 6 is placed onto the supporting structure 9, a supporting arm 8 can only be fitted in the region of a particular clearance 69. Outside the clearances 69, the section surrounds the underside 66 of the groove 60 to such an extent that it is placed on the front side 90 of the supporting structure 9 in a manner which is as free from gaps as possible. The shaped rods 6 are generally arranged over the entire width of a supporting structure 9. However, depending on the design concept, it is also possible for only subsections of the shaped rod 6 to be placed onto the supporting structure 9. The rear side 92 of the supporting structure 9 can also be fitted in the same manner. The supporting arm 8 with the rod part 80 and the plug-in plate 81 which has the tongue 83 and the flat portion 84 has no other changes.

FIGS. 13A to 13B

The here used seventh embodiment of the shaped rod 7 also is intended for insertion into a supporting structure 9 and has, as the fifth embodiment according to FIG. 3B—viewed in a vertical cross section—, a vertical base limb 73 and a central limb 74 crossing the base limb 73 centrically and rectangularly, which central limb 74 in the fitted in state projects from the front side 90 of the supporting structure 9 and freely directing into the space ending with its front edge 72. A groove 70 extending longitudinally and rising towards the close front edge 72 which is provided again at the underside of the central limb 74. With the seventh embodiment, however, the central limb 74 extends over the base limb 73 and the rear side 92 of the supporting structure 9. The back section 740 of the central limb 74 projecting the supporting structure 9 and being in contact with the rear side 92 extends rectangularly folded upwards and downwards nearly up to the upper and nearly down to the lower end of the base limb 73. Therefore between the base limb 73 and the back section 740 respectively above and below of the central limb 74 a slit 730 is formed, and an angled stopper 731 is formed respectively above and below the central limb 74 in the direction of the front side 90 between the base limb 73 and the central limb 74. From the back section 740 an extension 741 projects respectively upwards and downwards, wherein the extensions 741 at first extend parallel to the rear side 92 lengthening the back section 740, then folded being in contact with the rear side 92 and thereby encircling respectively a screw groove 742.

When the shaped rod 7 is inserted into the supporting structure 9 an upper and a lower panel 96*a,* 96*b* with their horizontal longitudinal edges push respectively from above and below against the central limb 74. Grooves 97 are provided in the longitudinal edges, so that two tongue edges 98 adjoining to the grooves 97 are formed. Thereby each one of the tongue edges 98 of each panel 96*a,* 96*b* comes to lie in the slits 730, and the other tongue edges 98 are positioned into the angled stoppers 731. The central limb 74 lies between the longitudinal edges of both panels 96*a,* 96*b* and the base limb 73, which reaches respectively into the grooves 97, forms quasi the tongue as a connection of both panels 96*a,* 96*b*. The broadened back section 740 being placed on the rear side 92 of both panels 96*a,* 96*b*. The screw grooves 742 are enclosed between the rear side 92 and the extensions 741. The base limb 73 can be provided with a surface toothing for its improved seat within the grooves 97.

The front edge 72 of the central limb 74 projects from the front side 90 of the joined together panels 96*a,* 96*b* so far in that the groove 70 remains accessible for the insertion of the undivided or divided bended tongue 83 of the plug-in plate 81 of the supporting arm 8. In the fitted state the tongue 83 engages into the groove 70 and the flat portion 84 of the plug-in plate 81 lies on the front side 90 of the lower panel 96*b*. The rod part 80 projecting into the space extends from the flat portion 84. The fitting and removal of the supporting arm 8 is done as described above.

To increase the variability of the shaped rod 7 a slotted grid 743 extending along the shaped rod 7 with a series of single slots 744 is provided within the section of the central limb 74, which projects form the front side 90 of both panels 96*a,* 96*b*. These slots 744 are intended for optional fitting of hanger arms, which can be fitted in from above and the supporting arms 8 are fitted in the shaped rod 7 from below. On the rear side 92 of the supporting structure 9 a vertical counterbracket 99 is attached, which crosses the shaped rod 7 and connects bridging-over the panels 96*a,* 96*b*. The counterbracket 99 and the shaped rod 7 are preferably detachable connected with each other by screws 990, which are positioned in the screw grooves 742. The panels 96*a,* 96*b* and the counterbracket 99 are also preferably screwed together with each other, so that the supporting structure 9 with the shaped rods 7 inserted between the panels 96*a,* 96*b* results in a strong compound.

FIG. 13C to 13D

The hanger arms 8' additionally insertable from below into the slots 744 having a rod part 80' extending into the space and a plug-in plate 81' arranged at the rod part 80', which plug-in plate 81' has above it a U-shaped bended hook part 83' that is downwardly open. The hook part 83' is intended to engage into one of the chosen slots 744 and to embrace the front edge 72 of the shaped rods 7. Goods can be directly hung up on the rod part 80' or the rod part 80' supports eventually together with an adjoining hanger arm 8'—a goods carrier receiving the goods to be presented. Preferably the rod part 80' penetrates through the plug-in plate 81' with a stump 88', so that in the fitted state the distance to the front side 90 of the supporting structure 9 is bridged-over. The hanger arm 8' supports itself with the end of the rod part 80' facing to the front side 90, i.e. with the stump 88', on the front side 90.

FIG. 13E

This shaped rod 7, which is inserted between two panels 96*a,* 96*b* forming a supporting structure 9, is hinged as well as with a supporting arm 8 as with a hanger arm 8'. The tongue 83 (here not visible) of the plug-in plate 81 of the supporting arm 8, which has been fitted in from below the shaped rod 7, engages into the groove 70 at an optional position along the shaped rod 7. The flat portion 84 of the plug-in plate 81 supports itself on the front side 90 of the lower panel 96*b*. The U-shaped hook part 83' of the hanger arm 8', which has been fitted in from above the shaped rod 7, engages into a chosen slot 744. The hook part 83' embraces the front edge 72 of the shaped rod 7 and the stump 88' of the rod part 80' touches against the front side 90 of the lower panel 96*b*. The supporting arm 8 can be fitted in at any position along the shaped rod 7, the hanger arm 8'. however, only at the positions defined by the slots 744.

FIG. 13F

Two vertical counterbrackets 99, parallel spaced to each other, are fixed on the rear. side 92 of the supporting structure 9 for its stabilization, when a display device is erected with several horizontally inserted shaped rods 7 between two respective panels 96*a,* 96*b*. The counterbrackets 99 cross the shaped rods 7 fixed thereto. Also the panels 96*a,* 96*b* are fastened to the counterbrackets 99, preferably screwed as well. The counterbrackets 99 themselves can be secured on a rear wall, e.g. walling. At least several of the screws 990 positioned in the screw grooves 742 could be used for this rearwardly fixation.

In addition to the above-described display devices further design variations can be realized. Express mention should be made here of the following:

- The shaped rods 4 and 5 of the first submodification having the cross-sectional geometry of a T-section do not have to be embedded in a T-groove 93 within the supporting structure 9. The base limbs 43,53 of the shaped rods 4,5 could also be placed and fastened on the supporting structure 9, for example screwed tight in a recessed manner, so that the relatively complex production of the T-groove 93 can be dispensed with.
- It is not necessary for the shaped rods 4,5 to be designed as T-sections. The function would also be achievable using a bisected base limb 43,53—whose upper or lower wing would be dispensed with, resulting in an angle section.
- Instead of the solid material shaped rods 1,2 and 3 used, hollow sections of sufficient stability could also be used, in which case the plug-in groove 20 and the oblique surfaces 30,31 could advantageously be produced by reshaping.
- Instead of the screw connection of the bolts 10 protruding through the through-holes 91 on the shaped rods 1,2,3, further types of fastening are also available to the expert. Thus, holding elements could connect the shaped rods 1,2,3 to the supporting structure 9 in a non-positive or positive manner.
- A further modification consists in producing, instead of the angle sections 4,5—by altering the base limbs 43,53—a solid or hollow section, the base portion of which is used for the placing on and fastening to the supporting structure 9.
- The oblique surface 58 can also be designed as a curved oblique surface 58.
- The sections 1,2,3,4,5,6,7 are preferably rail-shaped, rod-shaped or tubular. To achieve individual design effects sections are conceivable which do not have a constant cross section over the length. Such a section which changes in cross section and possibly is additionally curved could be used for mounting company logos in a conspicuous manner, for example.
- As a modification within the seventh embodiment of the shaped rod 7, you can following to the embodiments according to FIGS. 11A and 12A, the under sides extend around the groove 70 so far in that the groove 70 as such is not accessible for fitting in the plug-in plate 81 of a supporting arm 8. By arranging of grid-shaped recesses, supporting arms 8 can only be fitted in at the defined positions of the recesses. If a slotted grid 743 is present, the complementary hanger arms 8' can be arranged from above. If a slotted grid 743 and the recesses are provided two alternatives are available. The slotted grid 743 and the recesses could be congruent, i.e. the slots 744 are positioned and dimensioned in such a manner that they penetrate the shaped rod 7 vertically and open below as recesses. Or the slotted grid 743 and the recesses are arranged offset to each other.

The shaped rods 4 having the slotted grid 40 and the shaped rods 5 of the first submodification having the groove 50 at the bottom can also be divided into short pieces into which only one supporting arm 8 can fit. The T-grooves 93 made for the insertion of the shaped-rod pieces 4,5 into the supporting structure 9 can, for aesthetic reasons, be covered if they are not occupied.

For simplification of the display device it would be imaginable to combine the supporting arms 8 and the hanger arms 8' by combined design of the plug-in plate 81 and 81'. One edge of the plug-in plate 81,81' could have the design of the tongue 83 for engaging into the groove 50,60,70 and a further edge on the plug-in plate 81,81' is designed as a U-shaped hook part 83' for engaging into a slot 744. The tongue 83 or the hook part 83' of the combined supporting and hanger arm 8,8' is used according to its rotation for fitting in the arm 8,8' from below into the groove 50,60,70 or from above into a slot 744. The tongue 83 and the hook part 83' point—viewed from the middle section of the plug-in plate 81,81'—into opposite directions.

The front side 90 and rear side 92 of the supporting structure 9 are defined merely from the viewer's perspective. Given an appropriate structure, both sides 90,92 are in principle suitable for being occupied by the shaped rods 1,2,3,4,5,6,7.

We claim:

1. Display device for the presentation of goods comprising:

at least one shaped rod fastened essentially horizontally on a supporting structure;

at least one supporting arm which is fitted on said at least one shaped rod, said at least one supporting arm including a rod part having an axial direction and an upper side, and a plug-in plate which is attached onto one end of said rod part and which protrudes over said upper side of said rod part, said plug-in plate has a bevelled edge on its top portion that extends in said axial direction of said rod part;

said at least one supporting arm is fitted on said at least one shaped rod only when a free end of said rod part is raised relative to horizontal, thereby bringing said bevelled edge of said plug-in plate from below said at least one shaped rod up to the same position of said at least one shaped rod and lowering said free end of said rod part into an end position, wherein said at least one shaped rod is provided with an externally accessible longitudinal oblique surface which faces said supporting structure and on which said bevelled edge of said plug-in plate rests; and said plug-in plate having a flat portion and, when said at least one supporting arm is in a fitted end position, said flat portion of said plug-in plate is supported on said supporting structure.

2. Display device according to claim 1, wherein said at least one shaped rod has a round cross section and is placed onto said supporting structure at a gap distance therefrom; and said bevelled edge of said plug-in plate has an angle and said longitudinal oblique surface has an angle of ascent that is complementary to said angle of said bevelled edge.

3. Display device according to one of claims 1 or 2, wherein said at least one shaped rod has a horizontal central axis and is provided with another longitudinal oblique surface, said longitudinal oblique surface and said another longitudinal oblique surface being positioned symmetrically on either side of said central axis, whereby said at least one shaped rod is properly assembled, regardless of its rotational position.

4. Display device according to claim 2, wherein said at least one shaped rod has an oval cross section.

5. Display device according to claim 2, wherein said longitudinal oblique surface of said at least one shaped rod is continuous.

6. Display device according to claim 2, wherein said longitudinal oblique surface of said at least one shaped rod is sectional.

7. Display device according to claim 1, wherein said plug-in plate of said at least one supporting arm is attached perpendicularly onto one end of said rod part.

8. Display device according to claim 1, wherein said plug-in plate of said at least one supporting arm is attached obliquely onto one end of said rod part.

9. Display device according to claim 1, wherein said bevelled edge of said plug-in plate has a central indentation and two tongues, one of said two tongues being on one side of said central indentation and the other of said two tongues being positioned on an opposite side of said central indentation.

10. Display device according to claim 9, wherein a screw connection is between said at least one shaped rod and said supporting structure; and said indentation of said bevelled edge of said plug-in plate extends into said flat portion of said plug-in plate, such that said at least one supporting arm is also fitted proximately to said screw connection and a fastening bolt is positioned in said indentation with a spacer sleeve.

11. Display device according to claim 9, wherein said at least one shaped rod includes a plurality of shaped rods, each of said plurality of shaped rods having a length that is proportional to the width of said supporting structure, such that said plurality of shaped rods is arranged in lines and rows on said supporting structure; and said plurality of shaped rods includes a first group attached to a front side of said supporting structure and a second group attached to a rear side of said supporting structure.

12. Display device according to claim 11, wherein each of said plurality of shaped rods has a plurality of spaced-apart thickened portions;

and wherein said first group of shaped rods lies opposite to and in alignment with said second group of shaped rods; and wherein said first and second groups of shaped rods are connected to one another through said supporting structure.

13. Display device according to claim 12, comprising a plurality of pairs of said at least one shaped rods.

14. Display device according to claim 12, wherein said plug-in plate of said at least one supporting arm engages a corresponding one of said plurality of shaped rods between adjacent ones of said plurality of thickened portions when in said fitted end position.

15. Display device according to claim 12, wherein said plug-in plate of said at least one supporting arm engages a corresponding one of said plurality of shaped rods such that said indentation is engaged around a corresponding one of said plurality of thickened portions.

16. Display device according to claim 12, wherein said first group of shaped rods lies opposite to said second group of shaped rods forming pairs of opposed shaped rods, said shaped rods of each of said pairs of opposed shaped rods being screwed to one another through said supporting structure.

17. Display device according to claim 11, wherein said plug-in plate of said at least one supporting arm is movable to any position along said longitudinal surface of each of said plurality of shaped rods; and wherein said plurality of shaped rods that are attached to said front side of said supporting structure lie opposite to and are aligned with said plurality of shaped rods that are attached to said rear side of said supporting structure; and each of said plurality of shaped rods which lies opposite one another in pairs are connected to one another through said supporting structure.

18. Display device according to claim 17, wherein said first group of shaped rods lies opposite to said second group of shaped rods forming pairs of opposed shaped rods, said shaped rods of each of said pairs of opposed shaped rods being screwed to one another through said supporting structure.

19. Display device according to claim 9, wherein a screw connection is between said at least one shaped rod and said supporting structure; said at least one shaped rod has a thickened portion and said indentation of said bevelled edge of said plug-in plate extends into said flat portion of said plug-in plate, such that said at least one supporting arm is also fitted proximately to said screw connection and a fastening bolt is positioned in said indentation with said thickened portion of said at least one shaped rod.

20. Display device according to claim 1, wherein a facing is attached to said supporting structure and, when said at least one supporting arm is in its fitted end position, said flat portion of said plug-in plate is supported on said facing.

21. Display device for the presentation of goods comprising:

at least one shaped rod fastened essentially horizontally on a supporting structure;

at least one supporting arm which is fitted on said at least one shaped rod, said at least one supporting arm comprising a rod part having an axial direction and an upper side, and a plug-in plate which is attached onto one end of said rod part and which protrudes over said upper side of said rod part, said plug-in plate has a bevelled edge on its top portion that extends in said axial direction of said rod part; and said at least one supporting arm is fitted on said at least one shaped rod only when a free end of said rod part is raised relative to horizontal, thereby bringing said bevelled edge of said plug-in plate from below said at least one shaped rod up to the same position of said at least one shaped rod and lowering said free end of said rod part into an end position;

said at least one shaped rod is provided with a longitudinal groove, which is accessible from below for engagement of said bevelled edge of said plug-in plate; wherein said supporting structure has a horizontally oriented groove therein and said at least one shaped rod has an angled base portion and a central limb with a free portion, said at least one shaped rod being mounted onto said supporting structure, such that said free portion of said central limb extends outwardly from said supporting structure;

said central limb includes an underside with said longitudinal groove which ascends obliquely relative to its free outer edge and which remains accessible, even when said at least one shaped rod is placed in said groove of said supporting structure, and said bevelled edge of said plug-in plate penetrates into said longitudinal groove of said at least one shaped rod when said at least one supporting arm is fitted therein; and said plug-in plate having a flat portion and, when said at least one supporting arm is in a fitted end position, said flat portion of said plug-in plate is supported on said supporting structure.

22. Display device according to claim 21, wherein said longitudinal groove of said at least one shaped rod has a widened entrance opening, said entrance opening having a minimum depth to receive a substantial portion of said bevelled edge and an oblique surface facing said outer edge of said central limb, and wherein said bevelled edge engages said oblique surface in a fitted position, whereby said bevelled edge is pushed along said oblique surface into said longitudinal groove of said at least one shaped rod to compensate for dimensional tolerance.

23. Display device according to one of claim 21 or 22, wherein said longitudinal groove of said at least one shaped rod has a plurality of defined fitting positions, said longitudinal groove of said at least one shaped rod is thereby made accessible only at each of said plurality of defined fitting positions which are spaced apart for receiving therein said bevelled edge of said plug-in plate;

said plurality of fitting positions include systematically successive clearances that are provided on said underside of said central limb of said at least one shaped rod; and between said clearances said underside of said at least one shaped rod extends to said supporting structure with minimum gap therebetween.

24. Display device according to claim 21, wherein said plug-in plate of said at least one supporting arm rise attached perpendicularly onto said one end of said rod part.

25. Display device according to claim 21, wherein said plug-in plate of said at least one supporting arm is attached obliquely onto said one end of said rod part.

26. Display device according to claim 21, wherein said longitudinal groove of said at least one shaped rod is accessible from below, over its entire length.

27. Display device according to claim 21, wherein said longitudinal groove of said at least one shaped rod has fitting positions arranged in a grid pattern and is accessible from below only at said fitting positions.

28. Display device according to claim 21, wherein said at least one shaped rod has a T-shaped cross-section.

29. Display device according to claim 21, wherein said at least one shaped rod has a angled cross-section.

30. Display device according to claim 21, wherein said at least one shaped rod is mounted onto said supporting structure by placing said base portion into said groove of said supporting structure.

31. Display device according to claim 21, wherein a facing is attached to said supporting structure and, when said at least one supporting arm is in its said fitted end position, said flat portion of said plug-in plate is supported on said facing.

32. Display device for the presentation of good comprising:

at least one shaped rod fastened essentially horizontally on a supporting structure;

at least one supporting arm which is fitted on said at least one shaped rod, said at least one supporting arm comprising a rod part having an axial direction and an upper side, and a plug-in plate which is attached onto one end of said rod part and which protrudes over said upper side of said rod part, said plug-in plate has a bevelled edge on its top portion that extends in said axial direction of said rod part;

said at least one supporting arm is fitted on said at least one shaped rod only when a free end of said rod part is raised relative to horizontal, thereby bringing said bevelled edge of said plug-in plate from below said at least one shaped rod up to the same position of said at least one shaped rod and lowering said free end of said rod part into an end position;

said at least one shaped rod is provided with a longitudinal groove, which is accessible from below for engagement of said bevelled edge of said plug-in plate; wherein said at least one shaped rod has a placing-on edge which is positioned on said supporting structure and is fastened thereon;

said longitudinal groove provided on an underside of said at least one shaped rod and ascends obliquely relative to its free front edge and remains accessible, even when said at least one shaped rod is positioned on said placing-on edge of said supporting structure, and wherein said bevelled edge of said plug-in plate penetrates into said longitudinal groove of said at least one shaped rod when said at least one supporting arm is fitted therein; and said plug-in plate having a flat portion and, in a fitted end position of said at least one supporting arm, said flat portion of said plug-in plate is supported on said supporting structure.

33. Display device according to claim 32, wherein said longitudinal groove of said at least one shaped rod has an entrance opening, said entrance opening having a minimum depth to receive a substantial portion of said bevelled edge and an oblique surface on which said bevelled edge engages when in a fitted end position, whereby said bevelled edge is pushed along said oblique surface and into said longitudinal groove of said at least one shaped rod to compensate for dimensional tolerance.

34. Display device according to one of claim 32 or 33, wherein said longitudinal groove of said at least one shaped rod has a plurality of defined fitting positions, said at least one shaped rod being attached to said supporting structure by said placing-on edge of said at least one shaped rod, and said longitudinal groove of said at least one shaped rod being accessible only at-each of said plurality of defined fitting positions which are placed apart for receiving therein said bevelled edge of said plug-in plate;

said plurality of fitting positions include systematically successive clearances that are provided on said underside of said at least one shaped rod; and between said clearances said underside of said at least one shaped rod extends to said supporting structure with minimum gap therebetween.

35. Display device according to claim 32, wherein said plug-in plate of said at least one supporting arm is attached perpendicularly onto said one end of said rod part.

36. Display device according to claim 32, wherein said plug-in plate of said at least one supporting arm is attached obliquely onto said one end of said rod part.

37. Display device according to claim 32, wherein said bevelled edge of said plug-in plate has a central indentation and two tongues, one of said two tongues being on one side of said central indentation and the other of said two tongues being positioned on an opposite side of said central indentation.

38. Display device according to claim 32, wherein said longitudinal groove of said at least one shaped rod is accessible from below over its entire length.

39. Display device according to claim 32, wherein said longitudinal groove of said at least one shaped rod has fitting positions arranged in a grid pattern and is accessible from below only at said fitting positions.

40. Display device according to claim 32, wherein a facing is attached to said supporting structure and, when said at least one supporting arm is in its said fitted end position, said flat portion of said plug-in plate is supported on said facing.

41. Display device for the presentation of good comprising:

at least one shaped rod fastened essentially horizontally on a supporting structure which has a horizontally oriented groove therein;

at least one arm which is fitted on said at least one shaped rod, said at least one arm comprising a rod part having an axial direction and an upper side, and a plug-in plate which is attached onto one end of said rod part and which protrudes over said upper side of said rod part, and said at least one shaped rod is provided with a longitudinal groove, wherein said at least one shaped rod is inserted into said supporting structure;

said longitudinal groove is provided on an underside of said at least one shaped rod and ascends obliquely relative to its free outer edge and remains accessible, even when said at least one shaped rod is placed in said groove of said supporting structure; and a plurality of slots arranged in a grid pattern is provided on a section of said at least one shaped rod that projects from a front side of said supporting structure.

42. Display device according to claim 41, wherein said supporting structure includes a pair of individual panels, each having at least one longitudinal edge and a rear side, said at least one shaped rod being inserted therebetween;

said at least one longitudinal edge of each of said pair of individual panels engaging said at least one shaped rod and being assembled together with a base limb of said at least one shaped rod;

said at least one shaped rod includes a back section that bridges over both of said at least one longitudinal edges of said pair of individual panels and on said rear sides of each of said pair of individual panels; and said back section is broadened with extensions that are folded forwards thereby forming a respective screw groove for insertion of fastening elements.

43. Display device according to claim 42, wherein said at least one shaped rod includes a rear side and at least one counterbracket attached thereto on said rear side of said at least one shaped rod, whereby additional shaped rods are fastened to said supporting structure; said at least one counterbracket attaching said pair of individual panels to said additional shaped rods; and said display device is fastened to a rear wall by said at least one counterbracket.

44. Display device according to claim 42, wherein said display device is fastened to a rear wall by fastening through at least one of said at least one shaped rod.

45. Display device according to claim 41, wherein each arm of said at least one arm is a hanger arm, whereby there is at least one hanger arm, each of said at least one hanger arm having an end facing towards said supporting structure; said plug-in plate having a hook part for engaging in one of said plurality of slots and for embracing said free outer edge of said at least one shaped rod; and said plug-in plate of each of said at least one hanger arm being penetrated by a stump of said rod part of a corresponding one of said at least one hanger arm, said stump engaging said front side of said supporting structure when in a fitted end position.

46. Display device according to claim 45, wherein said hook part permits said plug-in-plate to be fitted into said plurality of slots from above said at least one shaped rod.

47. Display device according to claim 45, wherein said plug-in plate of each of said at least one hanger arm includes a bevelled edge directed towards said supporting structure, said bevelled edge of each. of said at least one hanger arm touches against said front side of said supporting structure when in its said fitted end position.

48. Display device according to claim 48, wherein said rod part of said at least one hanger arm has a predetermined length and a predetermined angular ascent.

49. Display device according to claim 48, wherein said at least one hanger arm includes a plurality of hanger arms, whereby there is a plurality of rod parts, said plurality of rod parts being of varying lengths and varying angular ascents, and said plurality of hanger arms supporting goods carriers in horizontal planes, lying one above another.

50. Display device according to claim 41, wherein said plug-in plate of said at least one arm is attached perpendicularly onto said one end of said rod part.

51. Display device according to claim 41, wherein said plug-in plate of said at least one arm is attached obliquely onto said one end of said rod part.

52. Display device according to claim 41, wherein said longitudinal groove of said at least one shaped rod is accessible from below over its entire length.

53. Display device according to claim 41, wherein said longitudinal groove of said at least one shaped rod has fitting positions arranged in a grid pattern and is accessible from below only at said fitting positions.

54. Display device according to claim 41, wherein said plug-in plate includes a tongue for fitting said plug-in plate into said longitudinal groove from below said at least one shaped rod.

55. Display device according to claim 41, wherein each arm of said at least one arm is a supporting arm, whereby there is at least one supporting arm, said plug-in plate having a bevelled edge on its top portion that extends in said axial direction of said rod part;

said at least one supporting arm is fitted on said at least one shaped rod only when a free end of said rod part is raised relative to horizontal, thereby bringing said bevelled edge of said plug-in plate from below said at least one shaped rod up to the same position of said at least one shaped rod and lowering said free end of said rod part into a fitted end position;

said longitudinal groove of said at least one shaped rod is accessible from below for engagement of said bevelled edge of said plug-in plate;

said bevelled edge of said plug-in plate penetrates into said longitudinal groove of said at least one shaped rod when said at least one supporting arm is fitted therein; and said plug-in plate having a flat portion and, when said at least one supporting arm is in a fitted end position, said flat portion of said plug-in plate is supported on said supporting structure.

56. Display device according to claim 55, wherein said longitudinal groove of said at least one shaped rod has a plurality of defined fitting positions that include systematically successive clearances provided on said underside of said at least one shaped rod, said longitudinal groove being accessible only at said clearances into which said at least one supporting arm fits.

57. Display device according to claim 56, wherein said clearances are formed by passing through said plurality of slots.

58. Display device according to claim 56, wherein said plurality of slots and said clearances are offset relative to one another.

59. Display device according to claim 56, wherein said plug-in plate of said at least one supporting arm engages said longitudinal groove only at said clearances.

60. Display device according to one of claims 10, 21, 32, or 55, wherein said plug-in plate has a thickness which increases from said bevelled edge towards said flat portion, whereby, when said at least one supporting arm is in its said fitted end position, said rod part of said at least one supporting arm has a slight ascent thereby avoiding a visually disadvantageous downward tendency of said at least one supporting arm and to compensate for a downwards bending which occurs at high load.

61. Display device according to one of claims 10, 21, 32, or 55, wherein said rod part of said at least one supporting arm has a predetermined length and a predetermined angular ascent.

62. Display device according to claim 21, wherein said at least one supporting arm includes a plurality of supporting arms, whereby there is a plurality of rod parts, said plurality of rod parts being of varying lengths and varying angular ascents, and said plurality of supporting arms supporting goods carriers in horizontal planes, lying one above another.

63. Display device according to claim 55, wherein said bevelled edge of said plug-in plate has a central indentation and two tongues, one of said two tongues being on one side of said central indentation and the other of said two tongues being positioned on an opposite side of said central indentation.

64. Display device according to claim 55, wherein a facing is attached to said supporting structure and, when said at least on e supporting arm is in its fitted end position, said flat portion of said plug-in plate is supported on said facing.

* * * * *